US005937645A

United States Patent [19]

Hamamoto

[11] Patent Number: 5,937,645

[45] Date of Patent: Aug. 17, 1999

[54] HYDRAULIC DEVICE

[75] Inventor: Satoshi Hamamoto, Toyama-ken, Japan

[73] Assignee: Nachi-Fujikoshi Corp., Toyama, Japan

[21] Appl. No.: 08/772,853

[22] Filed: Dec. 24, 1996

[30] Foreign Application Priority Data

| | | | |
|---|---|---|---|
| Jan. 8, 1996 | [JP] | Japan | 8-016948 |
| Mar. 28, 1996 | [JP] | Japan | 8-097339 |
| May 1, 1996 | [JP] | Japan | 8-132583 |
| Jul. 23, 1996 | [JP] | Japan | 8-210468 |

[51] Int. Cl.[6] ..... F15B 13/06

[52] U.S. Cl. ..... 60/422; 60/426; 91/446

[58] Field of Search ..... 60/422, 426; 91/446

[56] References Cited

U.S. PATENT DOCUMENTS

| | | | |
|---|---|---|---|
| 4,617,854 | 10/1986 | Kropp | 60/422 |
| 4,739,617 | 4/1988 | Kreth et al. | 60/426 |
| 5,203,678 | 4/1993 | Sugiyama et al. | 91/446 |
| 5,271,227 | 12/1993 | Akiyama et al. | 91/446 |
| 5,386,697 | 2/1995 | Claudinon et al. | 91/446 |
| 5,394,697 | 3/1995 | Hirata | 60/426 |

FOREIGN PATENT DOCUMENTS

| | | |
|---|---|---|
| 4-19409 | 1/1992 | Japan . |
| 4-54303 | 2/1992 | Japan . |

*Primary Examiner*—Sheldon J. Richter

*Attorney, Agent, or Firm*—Venable; Robert J. Frank; Michael A. Sartori

[57] ABSTRACT

A hydraulic device comprises a variable displacement pump, a plurality of hydraulic actuators, a plurality of directional valves capable of controlling the delivery oil flowing into each of the actuators, a plurality of pressure compensation valves which compensate the pressures of respective directional valves, and a pump flow control valve capable of controlling the pump delivery. Each of the pressure compensation valves decreases its output flow to a particular actuator according to an increase in the loaded pressure of the particular actuator. With this arrangement, if the loaded pressure of the particular actuator suddenly changes, the loaded pressure attenuates to ensure stable operation of the hydraulic device. Further, the stable operation is fee of hunting for both low-load actuators and high-load actuators, regardless of an independent operation or a compound operation.

23 Claims, 7 Drawing Sheets

HYDRAULIC DEVICE

BACKGROUND OF THE INVENTION

1. Field of the Invention

The present invention relates to a hydraulic device used for a construction machine or the like. The hydraulic device has a plurality of directional valves which have a flow control function capable of controlling the pressure oil from a single hydraulic pump which flows into each of a plurality of actuators, and a plurality of pressure compensation valves for compensating the pressures of the respective directional valves.

2. Description of the Related Art

This type of hydraulic device is employed primarily for construction machinery and agricultural machinery; it is equipped with a load-sensing required-stream regulation function for controlling the delivery of a variable displacement pump according to loaded pressure. Further, the circuits connected to actuators are provided with pressure compensation valves to divide the pump delivery so as to prevent the respective actuators from interfering with each other due to the difference in loaded pressures, etc. among the respective actuators with a resultant change in speed of the actuators when driving the plurality of actuators at the sane time. Furthermore the hydraulic devices are equipped with a function known as an anti-saturation function for distributing pump delivery to the individual actuators at an appropriate ratio when the pump delivery is smaller than a predetermined required flow of the plurality of driven actuators, as disclosed, for instance, in U.S. Pat. No. 4,617,854 in which as a load-sensing required-stream regulation function, there is provided with a pump flow control valve which is adapted to cause a spring force and a maximum loaded pressure among the loaded pressures of the actuators to act in a direction for increasing the delivery of the variable displacement pump and to cause a delivery pressure to act in a direction for decreasing the delivery of the variable displacement pump in opposition to the foregoing acting forces, thus controlling the pump delivery according to loaded pressure. There has also been disclosed a hydraulic device in, for example, Japanese Patent Laid-Open No. 4-19409, wherein a pressure compensation valve is disposed on the downstream of a directional valve which has a flow control function, the pressure compensation valve is adapted in its respective control pressure chambers to cause a pressure (Pd') on the upstream side of the pressure compensation valve to act in a direction for opening the pressure compensation valve and is adapted to cause maximum loaded pressure (Pm) of actuators to act in a direction for closing the pressure compensation valve, thus providing the anti-saturation function.

According to the FIG. 2 of U.S. Pat. No. 4,739,617, a differential pressure control valve is provided to produce a secondary pressure (Pc=Pd−Pm) corresponding to the differential pressure between the delivery pressure (Pd) of a variable displacement pump and the maximum loaded pressure (Pa) of the actuators. The secondary pressure (Pc) supplied by the differential pressure control valve and an actuator loaded pressure (PL) which is a pressure on the downstream side of a directional valve both are adapted in its another respective control pressure chambers to act in a direction for opening the pressure compensation valve, and a pressure (Pz) on the downstream side of a pressure compensation valve is adapted in its another respective control pressure chambers to act in a direction for closing the pressure compensation valve. Further, Japanese Patent Laid-Open No. 4-54303 has disclosed in its FIG. 6 a hydraulic device which is equipped with a differential pressure detector for detecting the differential pressure between the delivery pressure (Pd) of a variable displacement pump and the maximum loaded pressure (Pm) among actuators, a controller for generating a control signal in response to an output received from the differential pressure detector, and an electromagnetic proportional valve which is actuated by the control signal generated and outputted by the controller and which outputs the secondary pressure (Pc) so as to secure the anti-saturation function.

The flow characteristic in of the pressure compensation valve which has such a conventional anti-saturation function is indicated by a balance between the operating pressure to open the pressure compensation valve in its control chambers and the operating pressure to close the same. A differential pressure between the loaded pressure (PL) of an actuator and a pressure (Pz) on the upstream side of a directional valve, that is, a differential pressure ΔP before and after the directional valve (hereinafter referred to as directional valve differential pressure),i.e. the directional valve differential pressure being expressed as: ΔP=Pz−PL=Pd−Pm=Pc The directional valve differential pressure is adapted to be proportional to the differential pressure between the delivery pressure of the variable displacement pump and the maximum loaded pressure of the actuator, i.e. the secondary pressure.

It is known, however, moving a load with high inertia in a hydraulic device which carries out the pressure compensation described above causes an unstable operation of a system with consequent hunting. For instance, the hunting is noticeable in operating a hydraulic excavator of a construction machine, when moving a swing motor for a cab or travel motors for crawlers with heavy load or a boom cylinder or other cylinder with heavy load, posing a problem of impaired operability. Specifically, an example is taken wherein a lever of a directional valve is moved by a certain amount in steps to operate an actuator, namely, a swing motor for a cab or the like, with high inertia. Firstly, the directional valve is opened to let oil to flow into an actuator; however, the actuator does not immediately move because the actuator has high inertia, thus causing the loaded pressure to rise momentarily. The rise in the loaded pressure causes the loaded pressure to act on the pressure compensation valve to widely open the pressure compensation valve. Thus, the actuator which has received a large flow is suddenly accelerated; however, the acceleration gradually attenuates although the speed increases, because the supply of the flow is limited once the actuator is started. Hence, the loaded pressure, which has suddenly risen, gradually goes down as the acceleration decreases; therefore, the opening of the pressure compensation valve accordingly grows smaller gradually and the flow supplied decreases. When the actuator loses the acceleration and reaches a constant speed, the constant speed is significantly higher than a target speed since the speed has resulted from the high acceleration at the start, whereas the then loaded pressure is considerably low since the acceleration has already attenuated. This causes the opening of the pressure compensation valve to become even smaller with a consequent lower differential pressure of the directional valve. Hence, the flow decreases and the actuator starts to slow down, but the actuator attempts to keep the speed because of the high inertia thereof, causing the loaded pressure to decrease further. This in turn causes the opening of the pressure compensation valve to be even smaller with a resultant even slower speed of the actuator; however, when the speed has decreased to a certain level, the loaded pressure gradually recovers and the opening of the pressure compensation valve gradually grows larger accordingly. The deceleration of the actuator eventually stops and reaches a constant speed; however, the constant speed is considerably lower than the target speed since it has gone through the sudden decrease at the early stage of the deceleration. At the same time, the then loaded pressure is back to a large level since the deceleration has stopped; therefore, the opening of the pressure compensation valve is large again and the differential pressure of the directional valve is accordingly back to high, thus causing the actuator to start accelerating. Once the actuator begins to accelerate, the same initial phenomenon mentioned above takes place again. Thus, the repetitious sudden acceleration and the sudden deceleration hardly fade and the hunting continues. In actual operation, the response delay of a pump device is added, resulting in a further complicated phenomenon. Thus, the circuit using pressure compensation valves has been posing a problem in that the hydraulic control system using the circuit tends to develop unstable operation and hunting when moving a load with high inertia. In the device disclosed in U.S. Pat. No. 4,617,854 or U.S. Pat. No. 4,739,617, the operating pressures in the opening and closing directions in each of respective control chambers of the pressure compensation valve are set to be equal; and the devices are also equipped with the anti-saturation function; however, no prevention of hunting has been disclosed or suggested. In a device disclosed in Japanese Patent Laid-Open No. 4-54303, an extremely small pressure receiving area in a control pressure chamber of the pressure compensation value is used to cause the delivery pressure of a main pump to act in a direction for opening the pressure compensation valve, so that when the differential pressure between the delivery pressure and the loaded pressure of an actuator increases, the outlet flow of the pressure compensation valve is increased to cancel a flow force so as to secure an outlet flow which is not affected by the flow force, thus preventing the hunting or unstable operation of the pressure compensation valve which is caused by the reduction in the outlet flow due to a flow force generated by the throttle part of the pressure compensation valve when a plurality of actuators are operated at the same time. Again, however, no preventive measures for a load with high inertia have been disclosed or suggested.

Furthermore, in all the prior art described above, the maximum loaded pressure (Pm) have been acting in a direction for closing a pump flow control valve which varies the displacement of the pump via a thin or a small diameter, long pilot line from a valve unit. Hence, when the viscosity of pump delivery oil increases at low temperature with a resultant excessive pressure loss in the line from the pump to the value unit, the pressure on the upstream side of the pressure compensation valve in the valve unit drops by the foregoing pressure loss. This causes the differential pressure of the directional valve to drop, significantly reducing the pump delivery flow supplied to the actuator.

When at least two actuators, out of the plurality of actuators must be driven in synchronization with each other regardless of the loaded pressure of the actuators as in a case where two travel motors for driving a pair of crawlers of a hydraulic traveling vehicle are run, control is performed by the pressure compensation valve so that the directional valve differential pressures before and after the directional valves will be equal by shifting the levers of the respective directional valves by the same stroke; therefore, it is expected that if equal flow is supplied to the respective travel motors, the hydraulic traveling vehicle will be able to travel straight. If, however, there is a machining error in the spools of the directional valves will, the openings of the throttles of the individual directional valves inevitably be different even when the differential pressures of the directional valves are made equal. This means that the flow supplied to the respective travel motors will not be the same. Likewise, if there is an error in the pressure receiving areas resulting from the machining errors in the pressure compensation valves, the differential pressures of the directional valves will not be equal even when the respective openings of the throttle of the individual directional valves being shifted by the same. This stroke are the same, posing a problem in that the hydraulic traveling vehicle is unable to travel straight.

Furthermore, when at least two hydraulic actuators with markedly different loads are operated at the same time, such as a swing hydraulic motor and a hydraulic boom cylinder of a hydraulic excavator for a cab, the excessive inertial load of the actuator with a higher load causes an excessive pressure to be generated at an actuator port at the inlet in the early stage of the simultaneous operation. As a result, most of pressure oil flows from an overload relief valve, which is installed at the actuator port at the inlet, into a tank, causing an effective delivery flow itself to be reduced. This has presented a problem in that the driving speed of the boom cylinder which is the hydraulic actuator with a lower load becomes extremely slow and a large energy loss of an engine results from the pressure oil flowing into the tank from the relief valve. After that, when the acceleration of the swing motor stops and a constant speed is reached, the loaded pressure of the swing motor suddenly drops. The pressure compensation valve for the swing Rotor is almost fully open by the excessive loaded pressure of the swing motor in the early stage; however, this opening suddenly becomes small as the loaded pressure suddenly drops. This has presented a problem in that the swing motor is unavoidably accompanied by a shock when it decelerates, and because this deceleration enables an additional (effective) delivery of the pump to be acquired, the boom conversely accelerates, resulting in an awkward motion.

SUMMARY OF THE INVENTION

The present invention has been made in view of the problems with the prior art and it is an object of the present invention to provide a hydraulic device which has a pressure compensation valve which enables both low-load actuator and high-load actuator to exhibit good operability free of hunting regardless of independent operation or compound operation. Another object of the present invention is to provide a hydraulic device having a pressure compensation valve which is of a simple structure, lower cost, higher reliability and which is also capable of flexible adaptation according to load conditions.

It is still another object of the present invention to provide a hydraulic device which prevents an excessive pressure loss from generating in a line from a pump to a valve unit due to an increased viscosity of the pump delivery oil at low temperature, causing a considerably reduced pump delivery flow supplied to an actuator.

It is a further object of the present invention to provide a hydraulic device having a pressure compensation valve which enables a hydraulic traveling vehicle to travel straight even if there is an error in a pressure receiving area resulting from machining errors in the pressure compensation valve or machining errors in spools of directional valves, when at least two actuators out of a plurality of actuators must be driven in synchronization with each other regardless of the loaded pressure of the actuators as in a case where two travel motors for driving a pair of crawlers of a hydraulic traveling vehicle are run.

It is yet another object of the present invention to provide a hydraulic device having a pressure compensation valve which is capable of supplying sufficient pressure oil to a small-load actuator and of ensuring a smooth operation free of a shock without causing a sudden change in the speeds of actuators even if the loaded pressure of a large-load actuator suddenly drops when the actuators having loads of extremely different magnitudes are operated at the same time and which is capable of reducing an energy loss and the burden on an engine.

To these ends, according to a first aspect of the present invention, there is provided a hydraulic device which comprises: a variable displacement pump, a plurality of hydraulic actuators driven by the delivery oil of the variable displacement pump, a plurality of directional valves which have a flow control function capable of controlling the delivery oil flowing into each of the plurality of actuators, and a plurality of pressure compensation valves which compensate the pressures of the respective directional valves; wherein the respective pressure compensation valves cause a pressure (Pz) on the downstream side of the pressure compensation valves and a maximum loaded pressure (Pm) of the plurality of actuators to act in a closing direction in their respective control pressure chambers, while they cause a pump delivery pressure (Pd) which is a pressure on the upstream side of the pressure compensation valves and an actuator loaded pressure (PL) which is a pressure on the downstream side of the directional valves to act in the opening direction of the pressure compensation valves in their another respective control pressure chambers to perform the pressure compensation; a pump flow control valve is provided which is adapted to communicate the delivery oil of the variable displacement pump with a displacement varying means of the variable displacement pump; the maximum loaded pressure (Pm) via a line and the acting force of the spring of the pump flow control valve are applied in a direction for closing the pump flow control valve to increase the displacement of the variable displacement pump, whereas the pump delivery pressure (Pd) is applied via another line in a direction for opening the pump flow control valve to decrease the displacement of the variable displacement pump; characterized in that an output flow of a particular pressure compensation valve supplied to a particular actuator is decreased according to an increase in the loaded pressure of the particular actuator.

With this arrangement according to the first aspect of the present invention, the output flow of the particular pressure compensation supplied to the particular actuator is decreased, that is, differential pressure of the directional valve is decreased, according to an increase in the loaded pressure of the particular actuator; therefore, even if the loaded pressure of its own suddenly changes, the actuator loaded pressure attenuates to ensure stable operation of a hydraulic control system so as to enable a pressure compensation characteristic of a pressure compensation valve which is unaffected by the maximum loaded pressure of the actuators or the delivery pressure of the variable displacement pump. Thus, a stable operation free of hunting for both low-load actuators and high-load actuators can be achieved regardless of an independent operation or a compound operation, providing an outstanding advantage which is not available with prior art. Moreover, the right-down gradient characteristic (for decrease of the output flow of the pressure compensation valve according to an increase in the loaded pressure of an actuator) of the pressure compensation of the pressure compensation valve can be easily set simply by changing an internal component of the pressure compensation valve, allowing a right-down gradient or curve to be achieved according to the load characteristic of each actuator, thus prevents hunting. Furthermore, since the structure of the pressure compensation valve is of simple, so that no high accuracy is required, contributing to lower cost and yet to higher reliability.

According to a second aspect of the present invention, there is provided a hydraulic device which has: a variable displacement pump, a plurality of hydraulic actuators driven by the delivery oil of the variable displacement pump, a plurality of directional valves which have a flow control function capable of controlling the pressure oil flowing into each of the plurality of actuators, a plurality of pressure compensation valves which compensate the pressures of the respective directional valves, a differential pressure control valve which generates a secondary pressure (Pc=Pd−Pm) corresponding to a differential pressure between a pump delivery pressure (Pd) and a maximum loaded pressure (Pm) of the actuators, and a pump flow control valve which is adapted to communicate the delivery oil of the variable displacement pump with the displacement varying means of the variable displacement pump;

wherein the respective pressure compensation valves are adapted so that a pressure (Pz) on the downstream side of the pressure compensation valves to act in a direction for closing the pressure compensation valve in its control pressure chamber and also cause a secondary pressure (Pc) supplied from the differential pressure control valve and an actuator loaded pressure (PL) which is a pressure on the downstream side of the directional valve to respectively act in a direction for opening the pressure compensation valve in its another respective control pressure chambers; characterized in that an acting force of a spring of the pump flow control valve is applied in a direction for closing the pump flow control valve to increase the displacement of the variable displacement pump, whereas the secondary pressure (Pc) is applied via a line in a direction for opening the pump flow control valve of the variable displacement pump to decrease the displacement of the variable displacement pump.

With this arrangement according to the second aspect of the present invention, the secondary pressure (Pc) is applied via a line in a direction for opening the pump flow control valve of the variable displacement pump to decrease the displacement of the variable displacement pump; therefore, even if the viscosity of the pump delivery oil at low temperature is increased, and an excessive pressure loss is generated in a line running from the pump to a valve unit, the secondary pressure (Pc) based on the differential pressure between the pump delivery pressure (Pd) and the maximum loaded pressure (Pm) in the valve unit is generated to control the pump delivery pressure (Pd) of a pump delivery pipe in the valve unit to a pressure corresponding to the acting force of the spring of the pump flow control valve in relation to the maximum loaded pressure (Pm) regardless of the magnitude of the pressure loss in the pump delivery line. Hence, unlike a conventional device, the pump delivery flow does not markedly decrease and the actuators do not slow down even at low temperature, whereas in the prior art, the maximum loaded pressure (Pm) is allowed to go through a long, thin or small diameter pilot line from the valve unit to cause the pump flow control valve for changing the displacement of the pump to close and to make the pump delivery pressure (Pd) act via another line in a direction for opening the pump flow control valve.

Preferably, the pressure compensation valves of the hydraulic device in accordance with the second aspect of the present invention may be adapted to decrease the flow of a particular pressure compensation valve communicating with a particular actuator according to an increase in the loaded pressure of the particular actuator, as disclosed in the first aspect of this invention. In this construction, the pump flow control valve of the hydraulic device may cause the maximum loaded pressure (Pm) in place of the secondary pressure (Pc) to be applied via a line in a direction for closing the pump flow control valve for driving the displacement varying means of the variable displacement pump to increase the displacement of the variable displacement pump, while causing the pump delivery pressure (Pd) to act via another line in a direction for opening the pump flow control valve to decrease the displacement of the variable displacement pump.

Further preferably, in the hydraulic device according to the second aspect of the present invention, in which the output flow of a particular pressure compensation valve communicating with a particular actuator is adapted to decreased as the loaded pressure of the particular actuator increases; the pressure compensation valves are provided on the upstream side of the associated respective directional valves; the pressure compensation valves cause outlet pressure on the downstream side thereof to act on a first pressure receiving area of a first control pressure chamber in a direction for closing the valves, cause the secondary pressure to act on a second pressure receiving area of a second control pressure chamber in a direction for opening the valves, and also cause the loaded pressure of the actuators to act on a third pressure receiving area of a third control pressure chamber in a direction for opening the valves; and the second and third pressure receiving areas are made nearly the same, while the first pressure receiving area is made larger than the third pressure receiving area.

In such a hydraulic device having the construction described above, when at least two actuators out of the plurality of actuators must be driven in synchronization with each other regardless of the loaded pressure of the actuators as in a case where two travel motors for driving a pair of crawlers of a hydraulic traveling vehicle are run, it is preferred that the values obtained by dividing the third pressure receiving areas of the two pressure compensation valves communicating with the two actuators by the first pressure receiving areas are the same. By so doing, when the pump delivery flow supplied to the right and left travel motors changes with a resultant difference in the number of revolutions, the loaded pressure of the motor receiving a larger flow rises; however, the flow of the pressure compensation valve decreases as the loaded pressure increases and the flow characteristics of the pressure compensation valves of the pair of right and left travel motors are made the same. Therefore, even if there is an error due to a machining error of the spools of the directional valves or a machining error in the pressure receiving areas of the pressure compensation valves, such errors lead to an increase in the loaded pressure of the motor receiving the larger flow. Since the differential pressure between the delivery pressure and the maximum loaded pressure is made constant, the rise in the loaded pressure causes the pressure compensation valve of the larger flow effects to reduce the directional valve differential pressure to decrease the flow to the associated motor, so that the inflow decreases and the running speed of the travel motor receiving the larger flow decreases. In the other travel motor, since the loaded pressure and the differential pressure between the delivery pressure and the maximum loaded pressure does not change, the flow does not change accordingly, and the number of revolutions does not change, either, thus ensuring good straight traveling performance. When making a turn, the loaded pressure of the travel motor receiving the larger flow increases to maintain the straight travel, but the openings of the right and left directional valves greatly differ at the time of making a turn. As a result, the great difference in opening cannot be corrected and the straight travel cannot be maintained, which results that the flow is supplied to the travel motors according to the operating lever strokes of the directional valves to allow the turn. According to the present invention, other than the improved pressure compensation valves, no special additional valve is required, providing such advantages as no increase in the size of the entire valve, lower cost, and greater ease of use. Preferably, the values obtained by dividing the third pressure receiving areas of the pressure compensation valves by the first pressure receiving areas range from 0.99 to 0.95, i.e. 99% to 95%. This is because, if the flow decreasing rate is too high, then excessive correction tends to be made when traveling straight with consequent meandering, or the system tries to keep the straight travel when making a turn, resulting in unsmooth operation; on the other hand, if the flow decreasing rate is too low, then correction cannot be made, adversely affecting straight travel.

Further preferably, in the hydraulic device according to the second aspect of the present invention wherein the flow of a particular pressure compensation valve communicating with a particular actuator is decreased as the loaded pressure of the particular actuator increases; the pressure compensation valves are provided on the upstream side of the associated respective directional valves; the pressure compensation valves cause outlet pressure on the downstream side thereof to act on a first pressure receiving area of a first control pressure chamber in a direction for closing the valves, cause the secondary pressure to act on a second pressure receiving area of a second control pressure chamber in a direction for opening the valves, and also cause the loaded pressure of the actuators to act on a third pressure receiving area of a third control pressure chamber in a direction for opening the valves; and the second and third pressure receiving areas are made equal, while the first pressure receiving area is made larger than the third pressure receiving area; when the loaded pressure of a first actuator of at least two among a plurality of hydraulic actuators is extremely higher than the loaded pressure of a second actuator, the value obtained by dividing the third pressure receiving area by the first pressure receiving area of the high-load pressure compensation valve communicating with the high-load actuator is set so that it is smaller than the value obtained by dividing the third pressure receiving area by the first pressure receiving area of the low-load pressure compensation valve communicating with the low-load actuator.

With this arrangement, if the loaded pressure of the high-load actuator suddenly rises, the flow to the high-load actuator decreases and the flow which corresponds to the decrease flow is supplied to the low-load actuator, thus preventing the low-load actuator from slowing down. Preferably, the value obtained by dividing the third pressure receiving area by the first pressure receiving area of the pressure compensation valve of the low-load actuator ranges from 1 to 0.98, and the value obtained by dividing the third pressure receiving area by the first pressure receiving area of the pressure compensation valve of the high-load actuator ranges from 0.97 to 0.94.

According to a third aspect of the present invention, there is provided a hydraulic device having: a variable displacement pump, a plurality of hydraulic actuators driven by the delivery oil of the variable displacement pump, a plurality of directional valves which have a flow control function capable of controlling the pressure oil flowing into each of the plurality of actuators, a plurality of pressure compensation valves which are disposed between the respective directional valves and the respective actuators and which compensate the outlet pressures of the respective directional valves with respect to the maximum loaded pressure among the actuators; characterized in that the respective pressure compensation valves cause the acting force of the springs of the pressure compensation valves and a maximum loaded pressure (Pm) of the actuators to act in a direction for closing the pressure compensation valves in their respective control pressure chambers, while they cause a pressure (Pd') on the upstream side of the pressure compensation valves to act in a direction for opening the pressure compensation valves in their another respective control pressure chambers; a differential pressure control valve which generates a secondary pressure (Pc=Pd−Pm) corresponding to the differential pressure between a pump delivery pressure (Pd) and the foregoing maximum loaded pressure (Pm) of the actuators is provided, and a pump flow control valve which causes the delivery oil of the variable displacement pump to communicate with a displacement varying means of the variable displacement pump; and wherein the secondary pressure (Pc) is applied via a line so that the pump flow control valve is closed to decrease the displacement of the variable displacement pump. This make it possible to provide the same advantages as those of a combination of the first and second aspect of the present invention.

BRIEF DESCRIPTION OF THE DRAWINGS

FIG. 2(*b*) is a fragmentary pump delivery control hydraulic circuit diagram which is different from that shown in FIG. 2(*a*) and the other portions of FIG. 2(*a*) are unchanged; FIG. 2(*c*) is a fragmentary hydraulic circuit diagram showing a secondary pressure generating unit which is different from that shown in FIG. 2(*a*); FIG. 2(*d*) is a hydraulic circuit diagram wherein the pressure compensation valves are disposed on the downstream side of the directional valves which is a different embodiment from the one shown in FIG. 2(*a*); FIG. 2(*e*) is a fragmentary hydraulic circuit diagram of a hydraulic device which drives two travel motors in synchronization with each other which is a different embodiment from the one shown in FIG. 2(*a*); and FIG. 2(*f*) is a fragmentary hydraulic circuit diagram of a hydraulic device which drives two actuators having significantly different loads and which is a different embodiment from the one shown in FIG. 2(*a*).

DETAILED DESCRIPTION OF THE PREFERRED EMBODIMENTS

Figure 1:
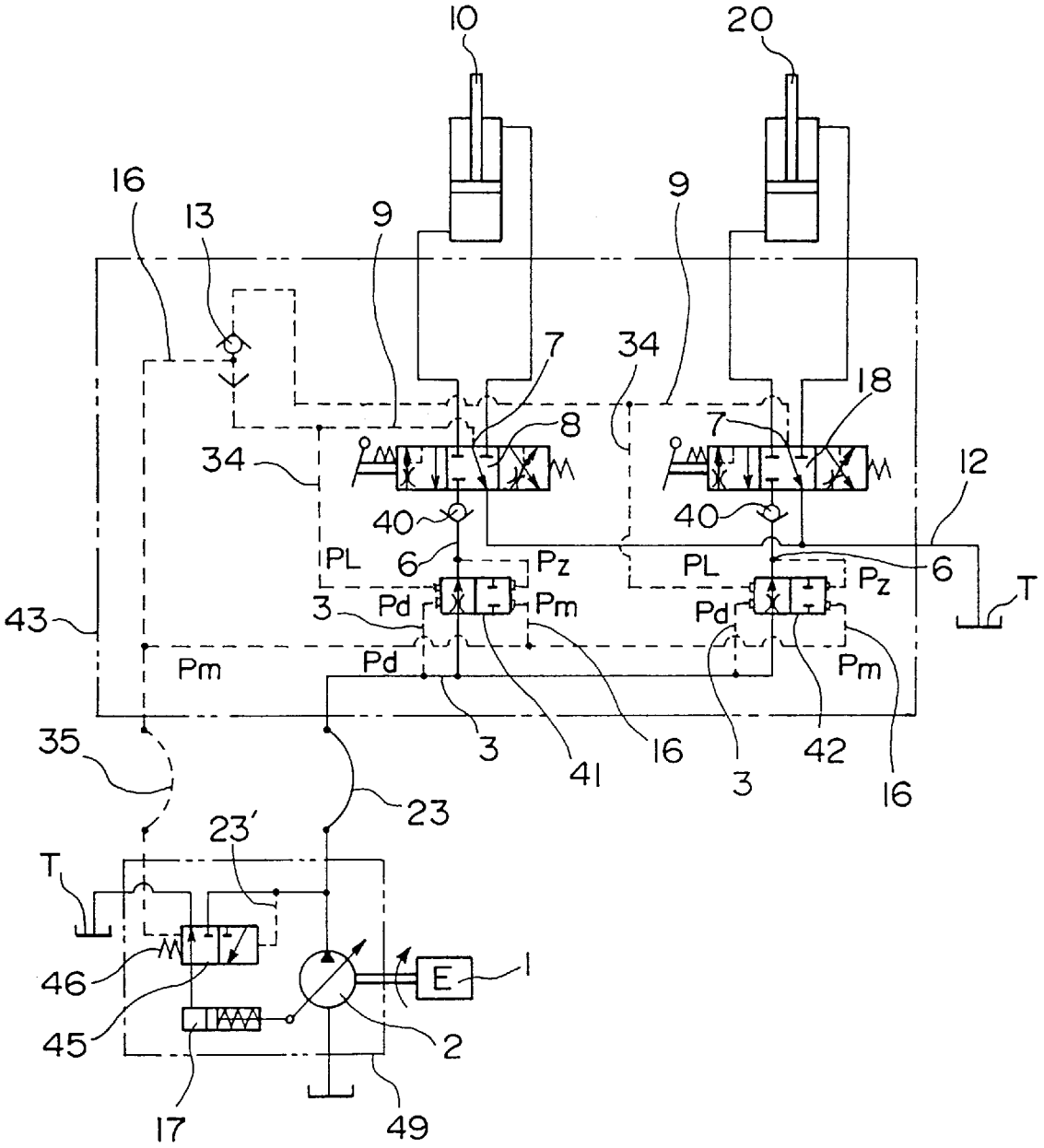
FIG. 1 is a hydraulic circuit diagram showing a hydraulic device which is an embodiment of a first aspect of the present invention.
Figure 2A:
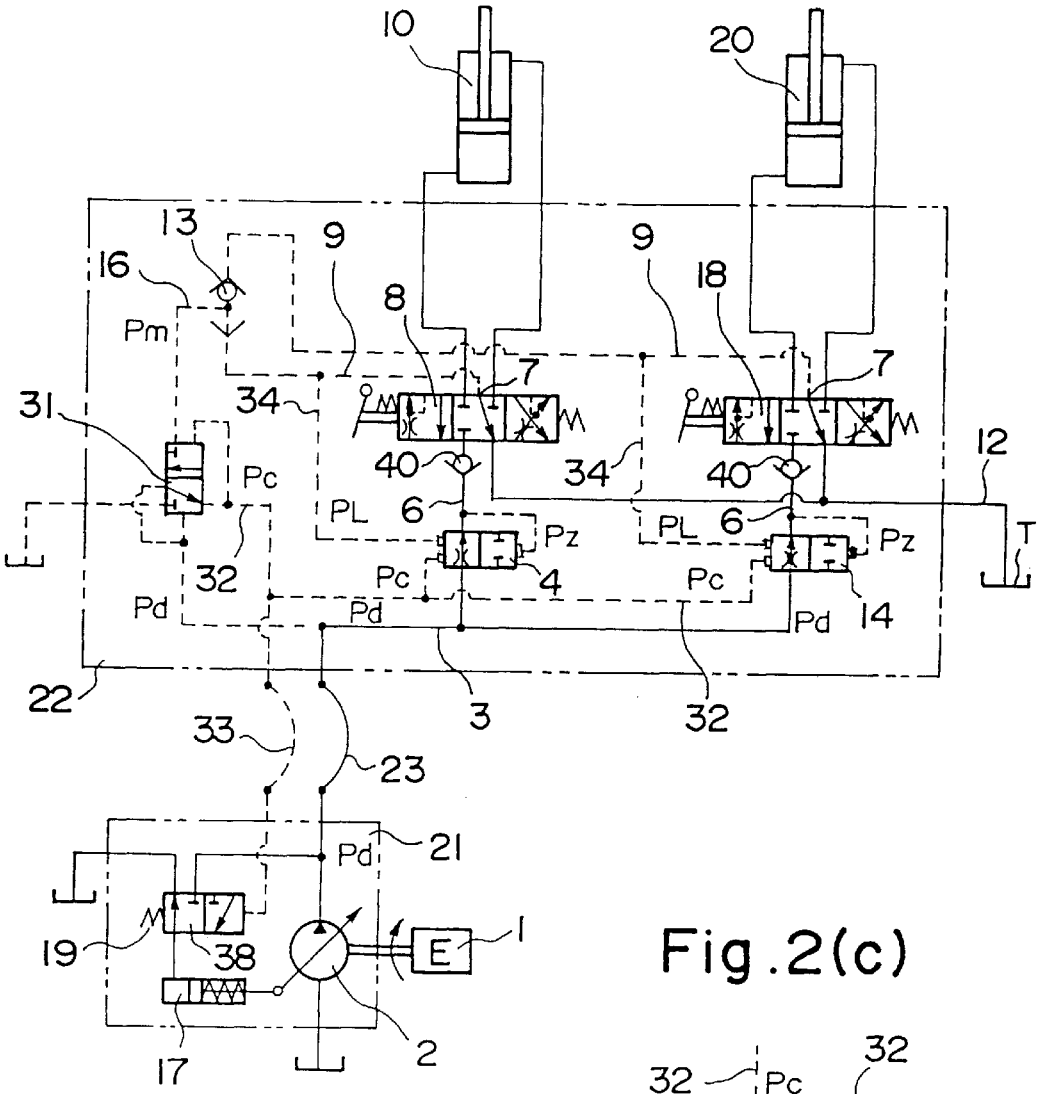
FIG. 2(*a*) is a hydraulic circuit diagram showing a hydraulic device which is an embodiment including a second aspect and the first aspect of the present invention.
Figure 2B:
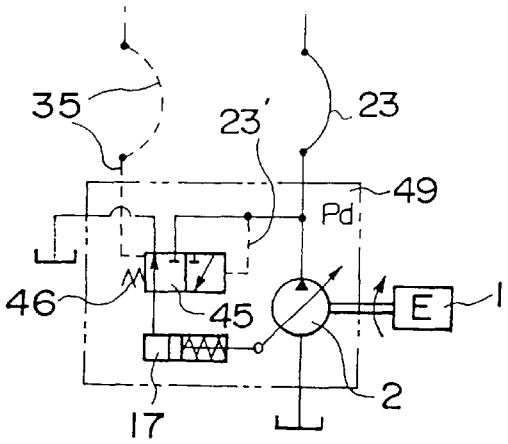
Figure 2C:
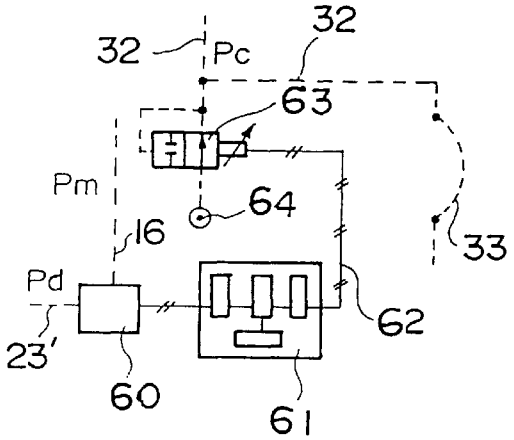
Figure 2D:
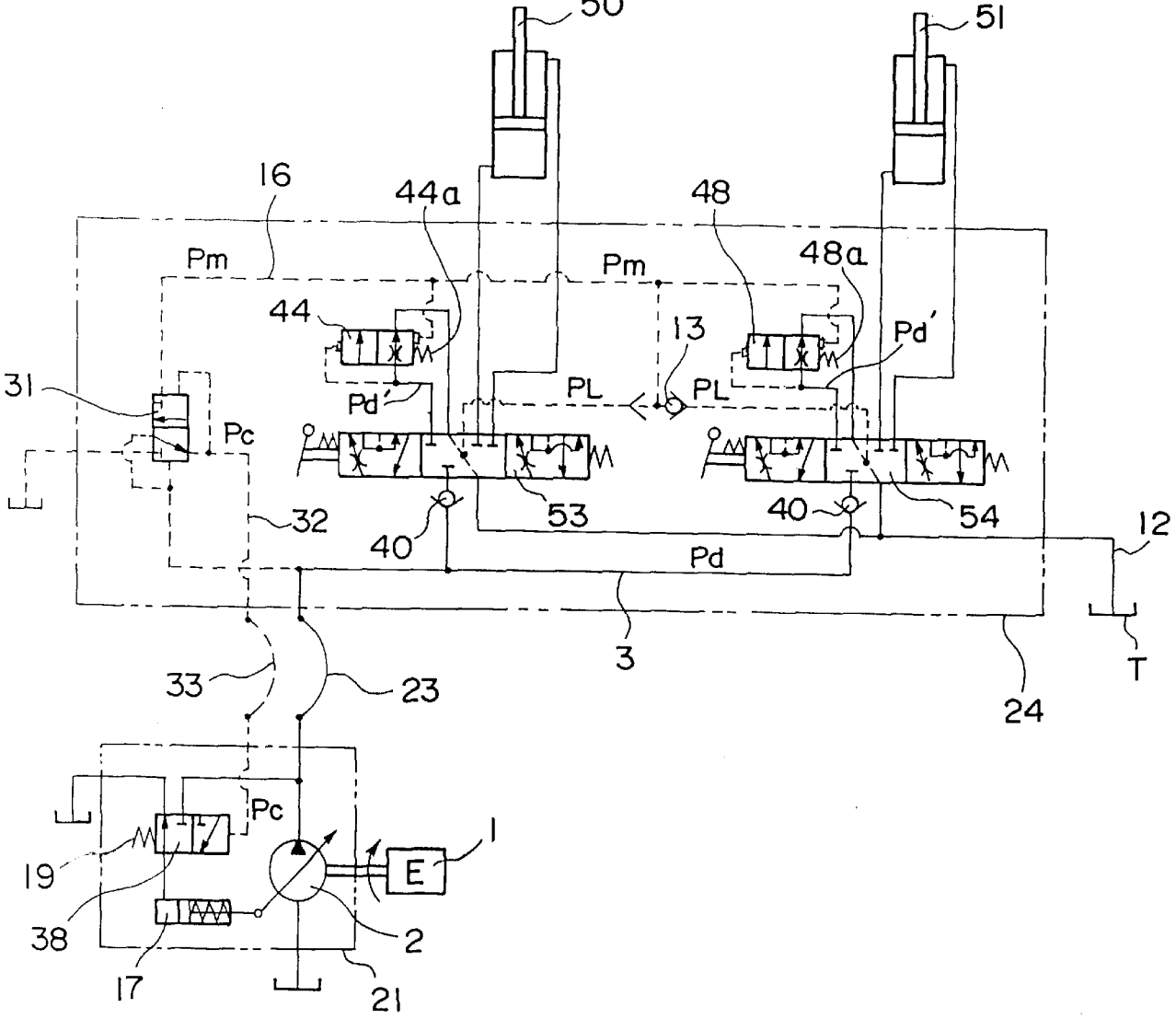
Figure 2E:
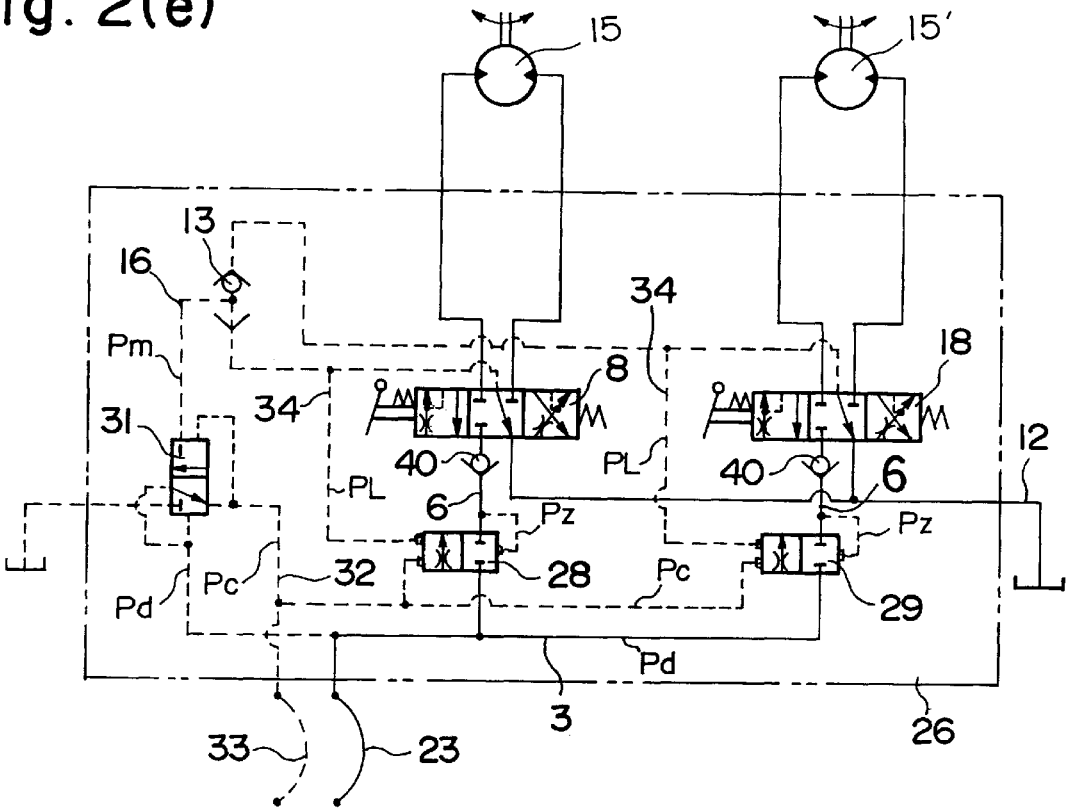
Figure 2F:
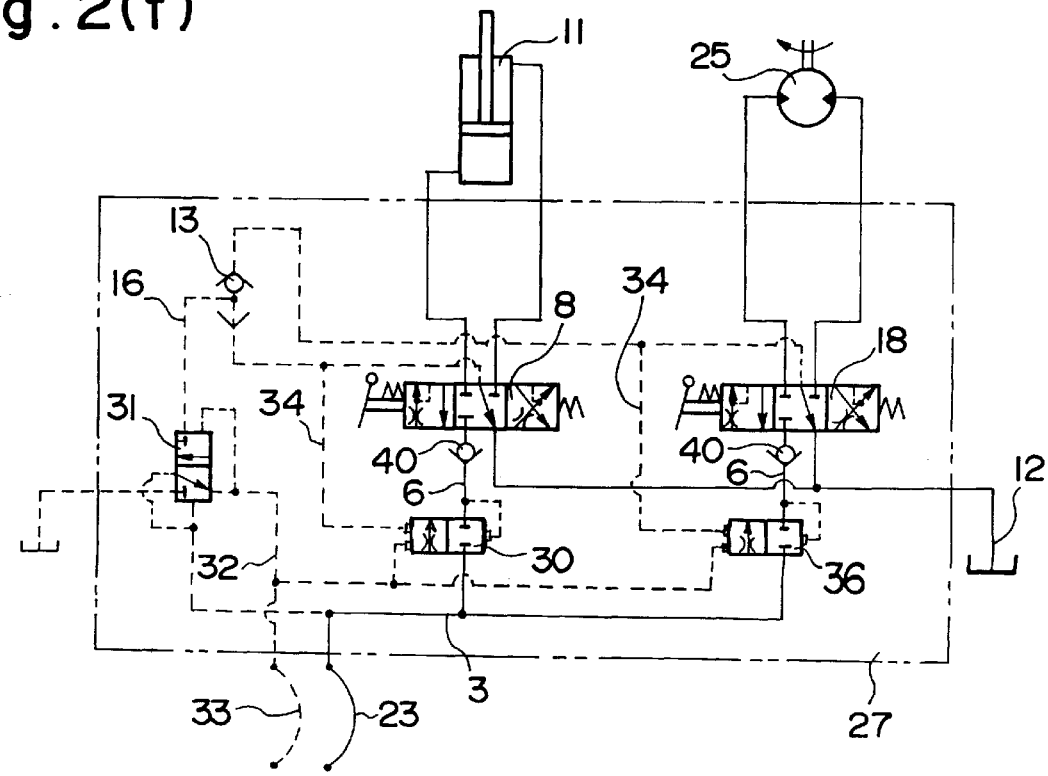

A hydraulic circuit diagram showing a hydraulic device which is a first aspect of the present invention will now be described with reference to FIG. 1.

A plurality of pressure compensation valves 41, 42, of which only two are shown, are connected in parallel to delivery lines 3, 23 of a variable displacement pump (hereinafter referred to as "pump") which is driven by an engine 1; a plurality of directional valves 8, 18, of which only two are shown, and which have a flow control function for controlling the delivery oil flowing into a plurality of actuators 10, 20, of which only two are shown, are respectively connected via check valves 40 to output lines 6 of the pressure compensation valves which compensate the pressures of the respective directional valves; and the output lines of the directional valves are respectively connected to the actuators 10, 20 so that the return oil from the respective actuators 10, 20 flow back to a tank T via a tank line 12 and the respective directional valves 8, 18. The loaded pressure, which is picked up through actuator loaded pressure pick-up ports 7 of the directional valves 8, 18 via loaded pressure pick-up lines 9, is supplied to a shuttle valve 13 which selects a maximum loaded pressure among those of the actuators 10, 20 (hereinafter referred to as "maximum loaded pressure")(Pm). The pressure compensation valves 41, 42 cause a pressure (Pz) on the downstream side of the pressure compensation valves and the maximum loaded pressure (Pm) to act in a closing direction in their respective control pressure chambers of the pressure compensation valves. Further, in other respective control pressure chambers of the respective pressure compensation valves 41, 42, a pump delivery pressure (Pd), which is a pressure on the upstream side of the pressure compensation valves, and an actuator loaded pressure (PL), which is a pressure on the downstream side of the directional valves, act in an opening direction of the respective pressure compensation valves 41, 42. The pressure compensation valves 41, 42 have an anti-saturation function which distributes the delivery of the pump 2 at an appropriate ratio to the actuators when the delivery of the pump 2 becomes lower than a predetermined required amount of the actuators 10, 20. There is also provided a pump flow control valve 45 which allows the delivery oil of the variable displacement pump 2 to communicate with a pump capacity varying device 17 of the variable displacement pump. The maximum loaded pressure (Pm) via a line 35 and the acting force of a spring 46 of the pump flow control valve are applied in a direction for closing the pump flow control valve 45 to increase the displacement of the variable displacement pump 2; the pump delivery pressure (Pd) is applied via another line 23' in a direction for opening the pump flow control valve 45 to increase the displacement of the variable displacement pump 2; the pump delivery pressure Pd is balanced with a preset acting force applied by the maximum loaded pressure Pm and the spring 46 so that the displacement of the variable displacement pump 2 is decreased when the acting force of the pump delivery pressure Pd is larger than the resultant acting force of the maximum loaded pressure Pm and the spring 46, and conversely, the displacement of the variable displacement pump 2 is increased when the acting force of the pump delivery pressure Pd is smaller than the resultant acting force of the maximum loaded pressure Pm and the spring 46. This provides a load sensing function for controlling the delivery of the variable displacement pump 2 according to the (maximum) loaded pressure. In the first aspect of the present invention, the flows of the pressure compensation valves 41 and 42 communicating with the actuators of the hydraulic device of FIG. 1 are decreased as the loaded pressures of the actuators increase.

With this arrangement; in the first aspect of the present invention, the areas of the control pressure chambers in the closing direction are made larger than that of the control pressure chamber in the opening direction so as to decrease the output flow of the pressure compensation valve communicating with a particular actuator, as the loaded pressure of the particular actuator increases (decreasing the differential pressure of the directional valve). Hence, even when the self-loaded pressure suddenly changes, the loaded pressure of the actuator attenuates to allow the hydraulic control system to maintain stable operation, thus enabling the pressure compensation valves to exhibit a pressure compensation which is unaffected by the maximum loaded pressures of the actuators or the delivery pressure of the variable displacement pump. This provides stable operation free of hunting for both low-load side and high-load side regardless of an independent operation or a compound operation, providing outstanding advantages which are not available with prior art.

The hydraulic circuit of a hydraulic device which is an embodiment of a second aspect of the present invention will be described with reference to FIG. 2(*a*).

Like parts as those of the embodiment shown in FIG. 1 will be assigned like reference numerals and the description thereof will be partially omitted. In the hydraulic circuit diagram given in FIG. 2(*a*), a shuttle valve 13 selects a maximum loaded pressure (Pm) among those of actuators 10, 20. A differential pressure control valve 31 which generates a secondary pressure (Pc) corresponding to the differential pressure between the delivery pressure (Pd) of a variable displacement pump and the maximum loaded pressure (Pm) is provided in a valve unit 22. Pressure compensation valves 4, 14 serve to cause an output pressure (Pz) on a downstream side 6 of the pressure compensation valves to act in a direction for closing the pressure compensation valve in its control pressure chamber of the pressure compensation valve; they also cause a secondary pressure (Pc) of a secondary pressure line 32 picked up from the differential pressure control valve 31 and a loaded pressure (PL) of a loaded pressure line 34 which is a pressure on the downstream side of the directional valve and which has been picked up from the actuators 10, 20 to act in a direction for opening the pressure compensation valves in its another respective control pressure chamber. A pump flow control valve 38 causes the delivery oil of a variable displacement pump 2 to communicate with a pump displacement varying means 17 of the variable displacement pump and it also applies the acting force of a spring 19 of the pump flow control valve to close the pump flow control valve so as to increase the displacement of the pump 2; and it causes the secondary pressure Pc to act via a line 33 so that the pump flow control valve 38 is opened to decrease the displacement of the pump 2. Further, the secondary pressure Pc is balanced with the acting force preset by the spring 19 to cause a pump displacement varying means 17 to decrease the displacement of the variable displacement pump 2 when the acting force of the secondary pressure Pc is larger than the acting force of the spring 19, or to increase the displacement of the variable displacement pump 2 when the secondary pressure Pc is smaller than the acting force of the spring 19, thus providing a load sensing function.

The operation of the hydraulic device shown in FIG. 2(*a*) will be described. The respective pressure compensation valves 4, 14 act to make the pressure on the upstream side 6 of the directional valves 8, 18 balanced with the sum of the loaded pressure (PL) and the secondary pressure (Pc) of respective actuators on the downstream side; therefore, assuming that the pressure receiving areas are the same, the directional valve differential pressure will be equal to the foregoing secondary pressure (Pc) regardless of the loaded pressures of the actuators, i.e. equal to the differential pressure between the pump delivery pressure (Pd) and the maximum loaded pressure (Pm) of the actuators. The secondary pressure (Pc) is led to a pump flow control valve 38 through a line 33, and since the secondary pressure (Pc) is balanced with the acting force of the spring 19 of the pump flow control valve 38, the delivery pressure (Pd) of the pump 2 is controlled so that the secondary pressure (Pc) becomes equal to a pressure which corresponds to the acting force of the spring 19. Hence, the directional valve differential pressures of the respective directional valves 8, 18 are also controlled to the pressure which corresponds to the acting force of the spring 19. With this arrangement, if, for example, the pump delivery is deficient, then the differential pressure between the pump delivery pressure (Pd) and the maximum loaded pressure (Pm) of the actuators, i.e. the secondary pressure (Pc), is no longer capable of securing the differential pressure preset by the foregoing spring 19; therefore, the respective directional valve differential pressures also become lower than the preset value, but the directional valve differential pressures become equal, so that the flow into the respective actuators 10, 20 are branched into flows which are equivalent to the ratio of the openings of the directional valves 8, 18, thus providing the anti-saturation function.

With such an arrangement, according to the second aspect of the present invention, the secondary pressure (Pc) is applied via the pilot line 33 in the direction for closing the pump flow control valve 38 of the variable displacement pump 2 and in the direction for decreasing the displacement of the variable displacement pump 2. Therefore, the viscosity of the pump delivery oil at low temperature is increased, and even if an excessive pressure loss is generated in a line 23 running from the pump 2 to a valve unit 22, the secondary pressure (Pc) in a line 32 based on the differential pressure (Pc) between the pump delivery pressure (Pd) of a pump delivery line 3 and the maximum loaded pressure (Pm) in the valve unit 22 is generated to control the pump delivery pressure (Pd) of the pump delivery pipe 3 in the valve unit 22 to a pressure corresponding to the acting force of the spring 19 in relation to the maximum loaded pressure of the actuators regardless of the magnitude of the pressure loss in the pump delivery line 23 from the pump 2 to the valve unit 22. Hence, unlike the prior art or the one shown in FIG. 1 wherein the maximum loaded pressure Pm is applied in the direction for closing the pump flow control valve 45 via the long, thin or small diameter pilot line 35 from the valve unit 43 and the pump delivery pressure Pd is applied in the direction for opening the pump flow control valve 45, the hydraulic device according to the second aspect of the present invention is so designed that the pump delivery flow does not markedly decrease and the actuators do not slow down even at low temperature.

In the hydraulic circuit of the embodiment shown in FIG. 2(*a*), the area of a control pressure chamber of the pressure compensation valve in the closing direction is made larger than that of a control pressure chamber of the pressure compensation valve in the opening direction so as to decrease the flow of the pressure compensation valve communicating with a particular actuator, as the loaded pressure of the particular actuator increases as disclosed in the first aspect of this invention. Thus, even when the self-loaded pressure suddenly changes, the loaded pressure of the actuator attenuates to allow the hydraulic control system to maintain stable operation, thus enabling the pressure compensation valves to exhibit pressure compensation which is unaffected by the maximum loaded pressures of the actuators or the delivery pressure of the variable displacement pump. This provides stable operation free of hunting for both low-load side and high-load side regardless of an independent operation or a compound operation, providing an outstanding advantage which is not available with prior art.

Figure 3:
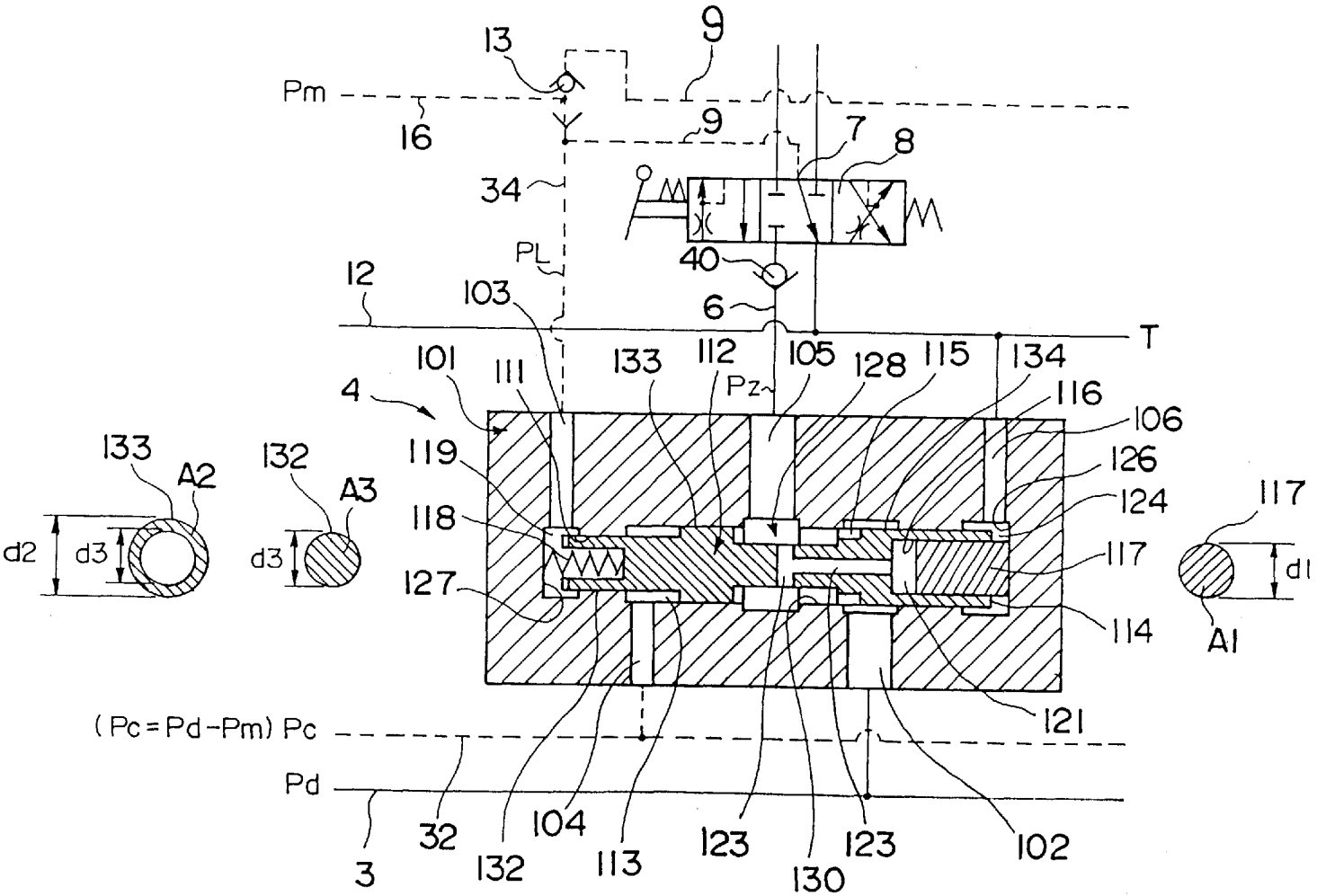
FIG. 3 is a conceptual structure diagram showing a section of an embodiment of a pressure compensation valve employed for the hydraulic device shown in FIG. 2(*a*).

Referring to FIG. 3, there is shown a configuration diagram of the section of an embodiment of the pressure compensation valves 4, 14 employed for the hydraulic device shown in FIG. 2(*a*), however they use the first aspect of this invention. The pressure compensation valves 4 and 14 share the same sectional configuration; therefore, the sectional configuration of the pressure compensation valve 4 will be described. As it will be discussed later, however, the pressure compensation valves 4 and 14 may be designed to have different pressure receiving areas of its respective control pressure chambers. The pressure compensation valve 4 has: a valve body 101; a valve body bore 128 provided in the valve body 101 which has two inside bores, namely, a small diameter bore 111 and a large diameter bore 130 continuing therefrom; a spool 112 having a small diameter portion 132, which is slidably fitted in the small diameter bore 111 (inside diameter d3), and first and second large diameter lands 133 and 134 which are slidably fitted in the large diameter bore 130 (inside diameter d2); and a loaded pressure port 103 of an actuator, a secondary pressure port 104, an outlet port 105, an inlet port 102 which communicates with a pump delivery line 3, and a tank port 106 all of which are provided in order on the valve body 101 along the valve body bore 128. The small diameter portion provided on one end of the spool 112 which fits in the small diameter bore 111 and is brought in contact with one end surface 127 of the valve body bore via a spring 118, and forms a third control pressure chamber 119 therebetween which communicates with the loaded pressure port 103, while the other end 114 of the spool 112 forms between the other end surface 126 of the valve body bore 128 an oil tank chamber 124 which communicates with the tank port 106.

A second control pressure chamber 113 which communicates with the secondary pressure port 104 is formed in the large diameter bore 130 encircling the connecting portion of the small diameter portion 132 of the spool 112 and the first large diameter land 133; a piston 117 is slidably inserted, in an oiltight and nested fashion, in an axial bore 116 (inside diameter dl), and the other end of the piston 117 is arranged so that it can be brought in contact with a right end surface of the valve body bore in the oil tank chamber 124 which communicates with the tank port 106. A first control pressure chamber 121 which communicates with the outlet port 105 via the pilot line 123 is formed between the spool 112 and the piston 117 in the axial bore 116. A first pressure receiving area A1 of the first chamber 121 is formed by the sectional area of the piston 117; a second pressure receiving area A2 of the second chamber 113 is formed by the area obtained by subtracting the sectional area of the small diameter bore 111 from the large diameter bore 130; a third pressure receiving area A3 of the third chamber 119 is formed by the sectional area of the small diameter portion 132. The spool 112 also has a notched throttle portion 115 which can be opened and closed to throttle the pump delivery flow from the inlet port 102 to the outlet port 105. The throttle portion 115 is provided on the second large diameter land 134 facing the first large diameter land 133. An outlet pressure Pz acts on the first chamber 121 communicating with the outlet port 105 to move the spool 112 to the left as observed in the drawing to close the notched portion 115; the secondary pressure Pc acts on the second pressure receiving area A2 of the second oil chamber 113 to move the spool 112 to the right as observed in the drawing to open the throttle portion 115; and the loaded pressure PL acts on the third pressure receiving area A3 of the third chamber 119 to move the spool 112 to the right as observed in the drawing to open the throttle portion 115.

In the embodiment shown in FIG. 3, the area of the third pressure receiving area A3 and that of the second pressure receiving area A2 are equal, and the outside diameter d3 of the small diameter portion 132 of the spool 112 is made slightly smaller than the outside diameter dl of the piston 117 (d3<d1) to make the third pressure receiving area A3 smaller than the first pressure receiving area A1. When the spool 112 is set to the left to the maximum stroke thereof as observed in FIG. 3, the left end surface of the spool 112 comes in contact with the end surface 127 of the valve body bore 128 to close the throttle portion 115. Conversely, when the spool 112 is set to the right to the maximum stroke thereof, the right end surface 114 of the spool and the right end surface of the piston 117 come in contact with the right end surface 126 of the valve body bore 128 to fully open the throttle portion 115. Then the spool 112 is set at the middle stroke thereof, the opening is increased in proportion to the rightward stroke of the spool by the throttle portion 115 of the spool. The spring 118 functions to move the spool 112 rightward to hold the throttle portion 115 open when the directional valve 8 or 18 is not in operation; it exerts an extremely weak acting force. FIG. 3 conceptually illustrates the operating principle. Both ends of the valve body bore 128 are not opened; however, in actual use, the valve body bore may be configured as a stepped through hole or a machined bore configured from the right side surface, which is not shown, and may be closed by a threaded plug or the like which is not shown.

The operation of the embodiment shown in FIG. 3 will now be described. Firstly, the balance of the forces applied to the spool 112 of the pressure compensation valve will be discussed. When a loaded pressure is denoted as PL, a pump delivery pressure is denoted as Pd, a maximum loaded pressure is denoted as Pm, and a secondary pressure is denoted as Pc (Pc=Pd−Pm), the force which acts to move the spool 112 rightward to open the notched throttle portion 115 may be expressed as:

$$(A3 \cdot PL)+(A2 \cdot Pc) \quad \ldots (1)$$

Conversely, the force which acts to move the spool 112 leftward in the drawing to close the notched throttle portion 115 may be expressed as shown below when an outlet pressure on an upstream side 6 of the directional valve, i.e. the outlet port 105, is denoted as Pz:

$$(A1 \cdot Pz) \quad \ldots (2)$$

The forces acting in the two opposite directions are balanced during the control by the pressure compensation valve and the results of the expression (1) and the expression (2) are equal; therefore, the following expression may be derived:

$$(A3 \cdot PL)+(A2 \cdot Pc)=(A1 \cdot Pz) \quad \ldots (3)$$

where the acting force of the spring 118 is ignored since it is extremely weak.

If it is assumed that the outside diameter d3 of the small diameter portion of the spool is equal to the outside diameter d1 of the piston 117, then A3=A1 and a directional valve differential pressure ΔP=(Pz−PL) may be expressed as shown below from the expression (3):

$$\Delta P=(Pz-PL)=(A2/A3) \cdot Pc \quad \ldots (4)$$

Accordingly, the directional valve differential pressure ΔP is set to a predetermined value by the secondary pressure Pc, the outside diameters d2 and d3 of the spool 112, and the outside diameter d1 of the piston 117; therefore, it becomes a constant value independent of the individual loaded pressures PL. Under a saturated condition, the secondary pressure Pc grows lower according to the condition and the directional valve differential pressures accordingly grow lower, but since the differential pressures are equal as previously described, the flow supplied to the respective actuators 10, 20 is branched into flows which are equivalent to the ratio of the throttle openings of the directional valves 8, 18, thus providing the anti-saturation function which protects the flow supplied to the respective actuators 10, 20 from being affected by the individual loaded pressures PL. The third pressure receiving area A3 and the second pressure receiving area A2 may be or may not be equal. If A2=A3, then ΔP=Pc; if A2≠A3, then the absolute value of ΔP can be changed by the ratio of the A2 to A3 as shown in the expression (4). The first pressure receiving area is determined by the relationship thereof with the third pressure receiving area.

In the first aspect of the present invention, the outside diameter d1 of the piston 117 is made slightly larger than the outside diameter d3 of the small diameter portion of the spool 112 (d1>d3). Hence, substituting A3=k·A1 (where k<1) into the expression (3) leads to the following expression:

$$k \cdot A1 \cdot PL+A2 \cdot Pc=A1 \cdot Pz \quad \ldots (5)$$

For the purpose of convenience, if k={1−(1−k)} in the above expression (5), then:

$$\{1-(1-k)\} \cdot A1 \cdot PL+A2 \cdot Pc=A1 \cdot Pz$$

This expression can be modified as follows:

$$A1 \cdot PL-A1 \cdot (1-k) \cdot PL+A2 \cdot Pc=A1 \cdot Pz$$

$$PL-(1-k) \cdot PL+(A2/A1) \cdot Pc=Pz-(1-k) \cdot PL+(A2/A1) \cdot Pc=Pz-PL$$

therefore, the directional valve differential pressure ΔP is determined by:

$$\Delta P=(Pz-PL)=(A2/A1) \cdot Pc-(1-k) \cdot PL \quad \ldots (6)$$

Or, substituting A1=A3/k into the expression leads to the following expression:

$$\Delta P=[(k \cdot A2)/A3] \cdot Pc-(1-k) \cdot PL \quad \ldots (7)$$

where the constant k is smaller than 1; therefore, the second terms of the right sides of the expressions (6) and (7) are negative values. According to the expressions (6) and (7), the directional valve differential pressures ΔP provide a linear expression of the secondary pressure Pc and the actuator loaded pressure PL; the respective directional valve differential pressures ΔP decrease and the flow decreases as the actuator loaded pressures PL increase. In other words, a right-down gradient characteristic of the pressure compensation value is obtained wherein the output flow decreases as the actuator loaded pressure PL increases.

The above applies whether only one directional valve is operated or two or more directional valves are operated at the same time, as long as the maximum delivery of the pump exceeds the flow required by all actuators, that is, as long as the saturated state has not yet been reached. Under this condition, as previously mentioned, the secondary pressure Pc is maintained at a constant level which has been set by the acting force of the spring 19. In contrast to this, since the loaded pressure PL provides each actuator loaded pressure, it consistently depends only on each actuator loaded pressure independently of other actuator loaded pressure, the maximum loaded pressure of the actuator, or the pump delivery pressure, thus exhibiting the right-down gradient characteristic of the pressure compensation value. Under a saturated condition where the pump delivery is insufficient, the secondary pressure Pc becomes a pressure Pc' which is smaller than the acting force preset by the spring 19; the magnitude of Pc' depends on the deficiency of the flow and it does not stay at a constant value. However, the same secondary pressure Pc' acts on all pressure compensation valves and therefor, the delivery of the pump is distributed to the individual actuators at an appropriate proportion.

If, only one directional valve is operated and the saturated condition is reached, then all the delivery is naturally supplied to the single actuator regardless of the actuator loaded pressure PL.

The following describes a case wherein two directional valves are operated and the saturation condition takes place. For the clarity of description, it will be assumed that the openings of both directional valves remain unchanged and the loaded pressure of only one actuator if rises, while the loaded pressure of the other actuator remains unchanged. The directional valve differential pressure ΔP of the actuator, the loaded pressure thereof has risen, decreases as the actuator loaded pressure PL increases according to the expressions (6) and (7). The flow itself, however, is small because the differential pressure of the first term is the small pressure Pc'. Regarding the directional valve differential pressure of the other actuator, the loaded pressure thereof remains unchanged, and the second terms of the expressions (6) and (7) remain unchanged since the actuator loaded pressure PL does not change; however, the decrease in the flow of the actuator which has the risen loaded pressure causes an allowance in the pump delivery flow as a whole and the secondary pressure Pc' increases, causing the first term to grow larger. As a result, the directional valve differential pressure increases with a consequent increase in the flow. In other words, as a whole, all the pump delivery is distributed to the actuators and the flow of the actuator with the unchanged loaded pressure increases by the volume corresponding to the decrease in the flow of the actuator with the risen loaded pressure. Accordingly, under the saturated condition, the flow of the actuator with the unchanged loaded pressure is increased due to the loaded pressure of the actuator with the risen loaded pressure despite the fact that the loaded pressure of its own stays constant; however, the flow actually supplied is deficient and smaller than a required flow under the saturated condition and therefore, no overshoot will take place with respect to a target speed. This characteristic, therefore, does not lead to hunting; rather, it provides an advantage in that the increase in the flow of the actuator with unchanged loaded pressure compensates the deficient flow, enabling a speed which is closer to the target speed.

The opposite phenomenon will take place if the other loaded pressure decreases. More specifically, the flow of the actuator with the decreased loaded pressure increases, while the flow of the actuator with the constant loaded pressure decreases. Further, if the loaded pressures rise or fall at the sane proportion, the flow changes with an unchanged dividing ratio. This applies also when three or more directional valves are operated at the same time. Thus, the present invention enables stable hunting-free controllability at all times even when there is sufficient pump delivery or under the saturated condition.

Further, it is obvious that the pressure compensation characteristic can be set to an arbitrary value by changing the value of the constant k. To be more specific, the smaller the value of k is set, the more right-down gradient characteristic of a pressure compensation value is obtained. This means that the right-down gradient can be set according to the load characteristic of each actuator. The setting can be completed simply by changing the outside diameter d1 of the piston 117 without the need for changing the valve body 101 itself, permitting easy setting change.

The value of the constant k is determined according to an actual device; in an actuator which is prone to hunting, an excessively small decreasing rate of compensating flow would lead to more likelihood of hunting, while an excessively large decreasing rate would disable the pressure compensating function for maintaining a constant flow; therefore, the value of k should be approximately 0.99>k>0.95 (0.99 to 95%). Thus, not only the degree of the right-down gradient or curve, but various values of k can be obtained easily also by using the same value body, making it possible to obtain various pressure compensation valves easily according to load conditions.

As illustrated in FIG. 2(*e*), in the hydraulic device using the circuit shown in FIG. 2(*a*), when at least two actuators 15, 15' out of a plurality of actuators must be driven in synchronization with each other regardless of the loaded pressure of the actuators as in a case where two travel motors 15, 15' for driving a pair of crawlers of a hydraulic traveling vehicle are run, it is preferred that the values obtained by dividing the third pressure receiving areas A3 of the two pressure compensation valves 28, 29 communicating with the two actuators 15, 15' by the first pressure receiving areas Al are the same. By so doing, when the pump delivery flow supplied to the right and left travel motors 15, 15' changes with a resultant difference in the number of revolutions, the loaded pressure of the motor receiving a larger flow rises; however, the flows of the pressure compensation valves decrease as the loaded pressure increases and the flow characteristics of the pressure compensation valves of the pair of right and left travel motors are made the same. Therefore, even if there is an error in the pressure receiving areas due to a machining error of the pressure compensation valves or a machining error of the spools of the directional valves 8, 18, such errors cause the loaded pressure PL of the motor receiving the larger flow to rise. Since the differential pressure Pc between the delivery pressure Pd and the maximum loaded pressure Pm is made constant, the rise in the loaded pressure causes the pressure compensation valve of the larger flow effects to reduce the directional valve differential pressure to decrease the flow to the associated motor, so that the inflow decreases and the running speed of the travel motor receiving the larger flow decreases. In the other travel motor, since the differential pressure between the maximum loaded pressure and the delivery pressure, and the loaded pressure does not change, the flow does not change accordingly, and the number of revolutions does not change, either, thus ensuring good straight traveling performance. Then making a turn, the loaded pressure of the travel motor receiving the larger flow increases to maintain the straight travel, but the openings of the right and left directional valves greatly differ at the time of making a turn. As a result, the great difference in opening cannot be corrected and the straight travel cannot be maintained. To cope with this, the flow is supplied to the travel motors according to the operating strokes of the directional valves to allow the turn. According to the present invention, other than the improved pressure compensation valves, no special additional valve is required, providing such advantages as no increase in the size of the entire valve, lower cost, and greater ease of use.

Preferably, the values obtained by dividing the third pressure receiving areas of the pressure compensation valves by the first pressure receiving areas range from 0.99 to 0.95, i.e. 99% to 95%. This is because, if the flow decreasing rate is too high, then excessive correction tends to be made when traveling straight with consequent meandering, or the system tries to keep the straight travel when making a turn, resulting in unsmooth operation; on the other hand, if the flow decreasing rate is too low, then correction cannot be made, adversely affecting straight travel.

As shown in FIG. 2(*f*), in the hydraulic device using the circuit shown in FIG. 2(*a*), when the loaded pressure of a high-load actuator 25 such as a swing hydraulic motor for cab of at least two actuators 11, 25 among a plurality of hydraulic actuators is extremely higher than the loaded pressure of the low-load actuator 11 such as a boom hydraulic cylinder, it is preferred to set the value, which is obtained by dividing the third pressure receiving area A3 of a high-load pressure compensation valve 36 communicating with the high-load actuator 25 by the first pressure receiving area A1, smaller than the value obtained by dividing the third pressure receiving area A3 of a low-load pressure compensation valve 30 communicating with the low-load actuator 11 by the first pressure receiving area A1. With this arrangement, if the loaded pressure of the high-load actuator 25 suddenly rises, the flow to the high-load actuator decreases and the flow which corresponds to the decrease flow is supplied to the low-load actuator 11, thus preventing the low-load actuator 11 from slowing down. Further preferably, the value obtained by dividing the third pressure receiving area A3 of the pressure compensation valve 30 of the low-load actuator 11 by the first pressure receiving area A1 ranges from 1 to 0.98, and the value obtained by dividing the third pressure receiving area A3 of the pressure compensation valve 36 of the high-load actuator 25 by the first pressure receiving area A1 ranges from 0.97 to 0.94.

Furthermore, when the loaded pressure of the high-load swing motor 25 is excessively high, the opening of the pressure compensation valve 36 is decreased to reduce the flow supplied to the swing motor 25; therefore, the wasteful relief flow running from an overload relief valve, not shown, to the tank, not shown, can be reduced and the rise of the loaded pressure itself of the swing motor 25 is also restrained. Hence, the drop in the speed of the boom hydraulic cylinder which is the low-load actuator 11 can be prevented by the amount of the reduced wasteful relief flow. After that, as the speed of the swing motor 25 increases and the acceleration thereof decreases, the loaded pressure also decreases. As a result, the opening of the pressure compensation valve 36 gradually increases and the flow gradually increases accordingly as the swing loaded pressure decreases, thus enabling the swing motor 25 to be gently accelerated. Further, when the acceleration of the swing motor ends and the swinging at a steady-speed is started, the loaded pressure of the swinging motor 25 suddenly drops, while the loaded pressure of the boom cylinder increases. At this time, the pressure compensation valve 36 of the swing motor 25 is in the process of gradually opening from a closed state rather than a fully open state and it is still in a throttled state. For this reason, even when the loaded pressure of the swing motor 25 suddenly drops, the chance of the opening of the pressure compensation valve 36 of the swing motor 25 being suddenly decreased will be reduced, thus preventing the swing motor 25 from decelerating with a shock. A relatively large opening of the pressure compensation valve 30 of the boom cylinder 11 is secured because a certain level of the secondary pressure is secured from the initial stage of the rotation of the swing motor 25; therefore, even when the swing motor ends the acceleration and shifts to the rotation at a steady speed, the opening does not suddenly increase as in the conventional art, thus preventing acceleration with a shock.

Figure 4:
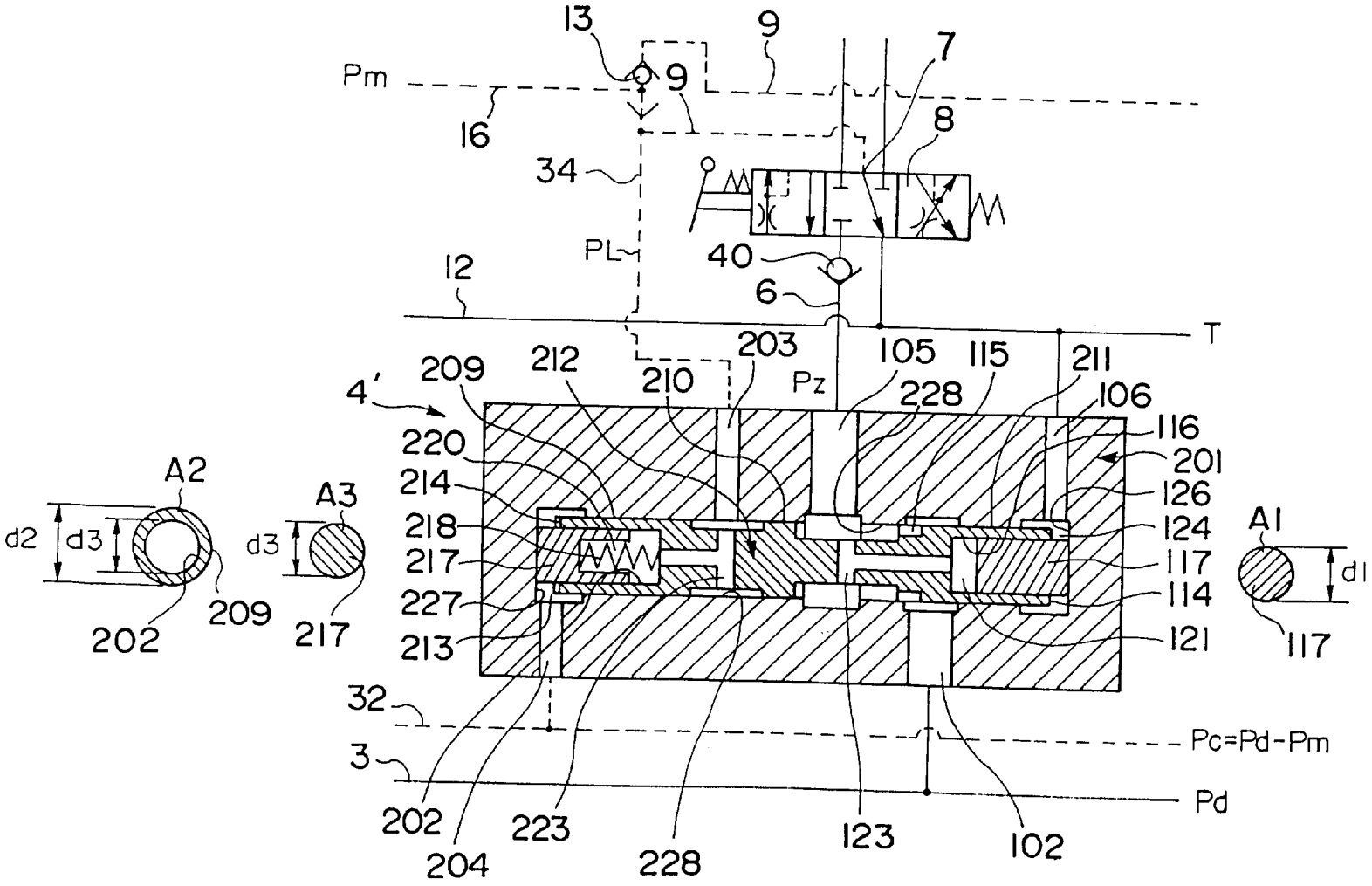
FIG. 4 is a conceptual structure diagram showing a section of an embodiment of a similar pressure compensation valve employed for the hydraulic device shown in FIG. 2(*a*), which embodiment is different from the one shown in FIG. 3.

Referring now to FIG. 4, a pressure compensation valve 4' employed for the hydraulic device shown FIG. 2(*a*), however which uses the first aspect of the present invention and which is different from the one shown in FIG. 3 will be described. Like parts as those of the embodiment shown in FIG. 3 will be assigned like reference numerals and the description thereof will be partly omitted. The pressure compensation valve 4' differs from the embodiment illustrated in FIG. 3 in the configurations of the pressure receiving areas A3 and A2 which act in the opening direction of the pressure compensation valve. Specifically, in FIG. 4, a valve body bore 228 of a valve body 201 has only a large diameter bore (inside diameter d2) in which a spool 212 having a first, second and third large diameter lands 209, 210, 211 is slidably fitted, and an auxiliary piston 217 which has an outside diameter d3 in place of a small diameter bore 111 (inside diameter d3) shown in FIG. 3 is slidably inserted in a sub-axial bore 202 provided on an outer end 214 of the spool 212 in a nested fashion. There are provided a secondary pressure port 204, an actuator loaded pressure port 203, an outlet port 105, an inlet port 102 which communicates with a pump delivery line 3, and a tank port 106 in order on the valve body 201 along a valve body bore 228. The outer end of the auxiliary piston 217 is arranged so that it can be brought in contact with an end surface 227 of the valve body bore 228, forming a second control pressure chamber 213 which communicates with the secondary pressure port 204. A spring 218 is provided between the spool 212 and the auxiliary piston 217 in the sub-axial bore 202, and a third control pressure chamber 220 which communicates with the loaded pressure port 203 via a pilot line 223 is formed. A first pressure receiving area A1 of a first control pressure chamber 121 is formed by the sectional area of a piston 117; a second pressure receiving area A2 of the second control pressure chamber 213 is formed by the area obtained by subtracting the sectional area of the auxiliary piston 217 from the sectional area of the valve body bore 228; and a third pressure receiving area A3 of the third chamber 220 is formed by the sectional area of the auxiliary piston 217.

With this arrangement, when the same relationship between the respective diameters d1, d2, and d3 as that of the embodiment illustrated in FIG. 3, the secondary pressure Pc, i.e. the differential pressure between the pump delivery pressure and the maximum loaded pressure of the actuators, provides the acting force of a spring 19 of a pump flow control valve 38. The loaded pressure PL is sufficiently large with respect to the secondary pressure Pc and therefore, the auxiliary piston is pressed against a left end surface of the valve body bore, thus providing the similar operation to that of one shown FIG. 3.

In the embodiment shown in FIG. 4, if the loaded pressure PL becomes excessively low for the secondary pressure Pc because of negative load such as in self-propelling load, then auxiliary piston 217 moves away from the left end surface of the valve body 227 to urge the spool 212, thereby causing the secondary pressure Pc to be applied to the pressure receiving area A3 to which the loaded pressure PL is applied. In this case, the loaded pressure is regarded as equal to Pc in carrying out the control, and the differential pressure of the directional valves becomes slightly higher to slightly increase the flow. While the embodiment shown in FIG. 3 has stepped bores, the embodiment shown in FIG. 4 requires no stepped bores and therefore it provides such advantages as simpler machining, and less likelihood of problems caused by the secondary pressure Pc being applied to the outer surface of the auxiliary piston 217, since the secondary pressure Pc is originally low, making it more suitable for an apparatus wherein the loaded pressure itself stays at a predetermined level or higher at all times.

The pressure compensation valves 4, 4' shown in FIG. 3 and FIG. 4 are described as to be used in the circuit shown FIG. 2(*a*), however, they are applicable also to other circuit configurations than the one shown in FIG. 2(*a*). Specifically, they are applicable as long as the pressure compensation valve is controlled so that the loaded pressure PL and the secondary pressure Pc act in the opening direction as described above and the pressure Pz on the upstream side of the directional valves, i.e. the downstream side of the pressure compensation valves, acts in the closing direction. For instance, the pressure compensation valves 4, 4' may be used to a circuit employing a pump delivery control circuit shown in FIG. 2(*b*), wherein, instead of applying the secondary pressure Pc to the pump control circuit via the pilot line 33 as shown in FIG. 2(*a*), the pump flow control valve 45 for making the delivery oil of the variable displacement pump 2 communicate with the pump displacement varying means 17 may be provided (as shown in FIG. 1); the maximum loaded pressure (Pm) may be applied via the line 35 in the direction for closing the pump flow control valve 45 to increase the displacement of the variable displacement pump 2; the pump delivery pressure (Pd) may be applied via another line 23' in the direction for opening the pump flow control valve 45 to decrease the displacement of the variable displacement pump 2; and the acting force of the pump delivery pressure Pd may be balanced with the acting force which is preset by the maximum loaded pressure Pm and the spring 46.

Furthermore, in the circuit shown in FIG. 2(*a*), the secondary pressure Pc may be generated in a way as shown in FIG. 2(*c*). Wherein the differential pressure between the delivery pressure (Pd) of the variable displacement pump from the pump delivery pressure pick-up line 23' and the maximum loaded pressure (Pm) of the actuators from the maximum loaded pressure pick-up line 16 may be detected by a differential pressure detector 60, and the output of the differential pressure detector 60 may be supplied to a control unit 61 which generates and outputs a control signal 62. The anti-saturation function may be secured by the secondary pressure (Pc) produced by an electromagnetic proportional valve 63 which is operated by the control signal 62. Reference numeral 64 denotes a pilot pump.

FIG. 2(*d*) shows a hydraulic circuit diagram illustrative of an embodiment of the hydraulic device which is different from the one shown in FIG. 2(*a*). In the hydraulic circuit diagram shown in FIG. 2(*d*), the pressure compensation valves are disposed on the downstream side of the directional valves as is the case with the one disclosed in Japanese Patent Laid-Open No. 4-19409 in this respect. Like parts as those shown in FIG. 2(*a*) are assigned like reference numerals, and the description thereof will be omitted. As illustrated in FIG. 2(*d*), actuators 50, 51 lead the pump delivery oil of a delivery line 3 via check valves 40, 40 and directional valves 53, 54 which have a flow control function and pressure compensation valves 44, 48; the return oil of the actuators 50, 51 is sent back from the directional valves 53, 54 to a tank T via a tank line 12. Of the loaded pressures of the actuators, the maximum loaded pressure is selected by a shuttle valve 13 to apply it with the acting forces of springs 44*a*, 48*a* in a direction for closing both pressure compensation valves 44, 48 in their respective control pressure chambers, and a pressure Pd on the downstream sides of the directional valves 53, 54 is applied in a direction for opening the pressure compensation valves in their another control pressure chambers. The differential pressure before and after the directional valves 53, 54 is set so that it coincides with the differential pressure between a delivery pressure Pd of a variable displacement pump and a maximum loaded pressure Pm as is the case with the one shown in FIG. 2(*a*), thus providing the anti-saturation function. As is the case with the one shown in FIG. 2(*a*), in a valve unit 24, a differential pressure control valve 31 is provided which generates a pressure Pc corresponding to the differential pressure between the delivery pressure Pd of the variable displacement pump of a delivery line 3 in a valve unit 24 and the maximum loaded pressure Pm of an outlet line 16 which has been selected through the shuttle valve 13. The secondary pressure Pc produced by the differential pressure control valve 31 is applied via a secondary pressure line 32 and a pilot line 33 so that a pump flow control valve 38 of a pump unit 21 causes the delivery oil of a variable displacement pump 2 to communicate with a pump displacement varying means 17 in order to decrease the delivery of the variable displacement pump 2, and also to control a spring 19 of the pump flow control valve 38 to close the pump flow control valve, thereby increasing the delivery of the variable displacement pump 2.

The operation of the hydraulic device shown in FIG. 2(*d*) will now be described. The pressure at the delivery port of the variable displacement pump 2 rises by the amount equivalent to the pressure loss generated in a delivery line 23, in relation to the pressure of the delivery line 3 in the valve unit 24; therefore, the pump delivery pressure Pd of the delivery line 3 depends only on the maximum loaded pressure Pm and the acting force of the spring 19 without depending on the temperature of pump delivery oil. Thus, the balance of the forces in the pump flow control valve 38 may be expressed as follows:

Pc=Operating force of the spring 19;

Because of the differential pressure control valve 31, the secondary pressure Pc is expressed as Pc=Pd−Pm; therefore, Pd−Pm=Acting force of the spring 19; and the pump delivery pressure is expressed as Pd−Pm+Acting force of the spring 19.

Further, based on the balanced forces in the pressure compensation valves,

Pd=Ps+Acting force of the spring 44*a*.

Hence, the differential pressure before and after the directional valves 53, 54 is expressed by Pd−Pd'=Acting force of the spring 19—Acting force of the spring 44*a*.

Thus, the differential pressure before and after the directional valves is determined only by the acting force of the spring 19 of the pump flow control valve 38 and the acting forces of the springs 44*a*, 48*a* of the pressure compensation valves 44, 48; it does not depend on the loaded pressure of the actuators 50, 51. Hence, the hydraulic device which is not influenced by the temperature of pump delivery oil can be achieved just like the one shown in FIG. 2(*a*).

The relationships indicated by the expressions above do not apply under a saturated condition because of the deficiency of pump delivery. A pressure Pd' on the downstream side of the directional valves 53, 54 will be the sum of the maximum loaded pressure Pm and the acting forces of the springs of the springs 44*a*, 48*a* of the pressure compensation valves, and the pressures on the downstream side of all the directional valves will be the same. The pressures on the upstream side of all the directional valves will be identical to Pd because they communicate with the delivery line 3 in parallel. Accordingly, the differential pressures before and after all the directional valves will be the same, and the delivery of the variable displacement pump will be divided at a ratio in proportion to the ratio of the openings of the respective directional valves, thus providing the anti-saturation function as is the case with the one shown in FIG. 2(*a*).

Figure 5:
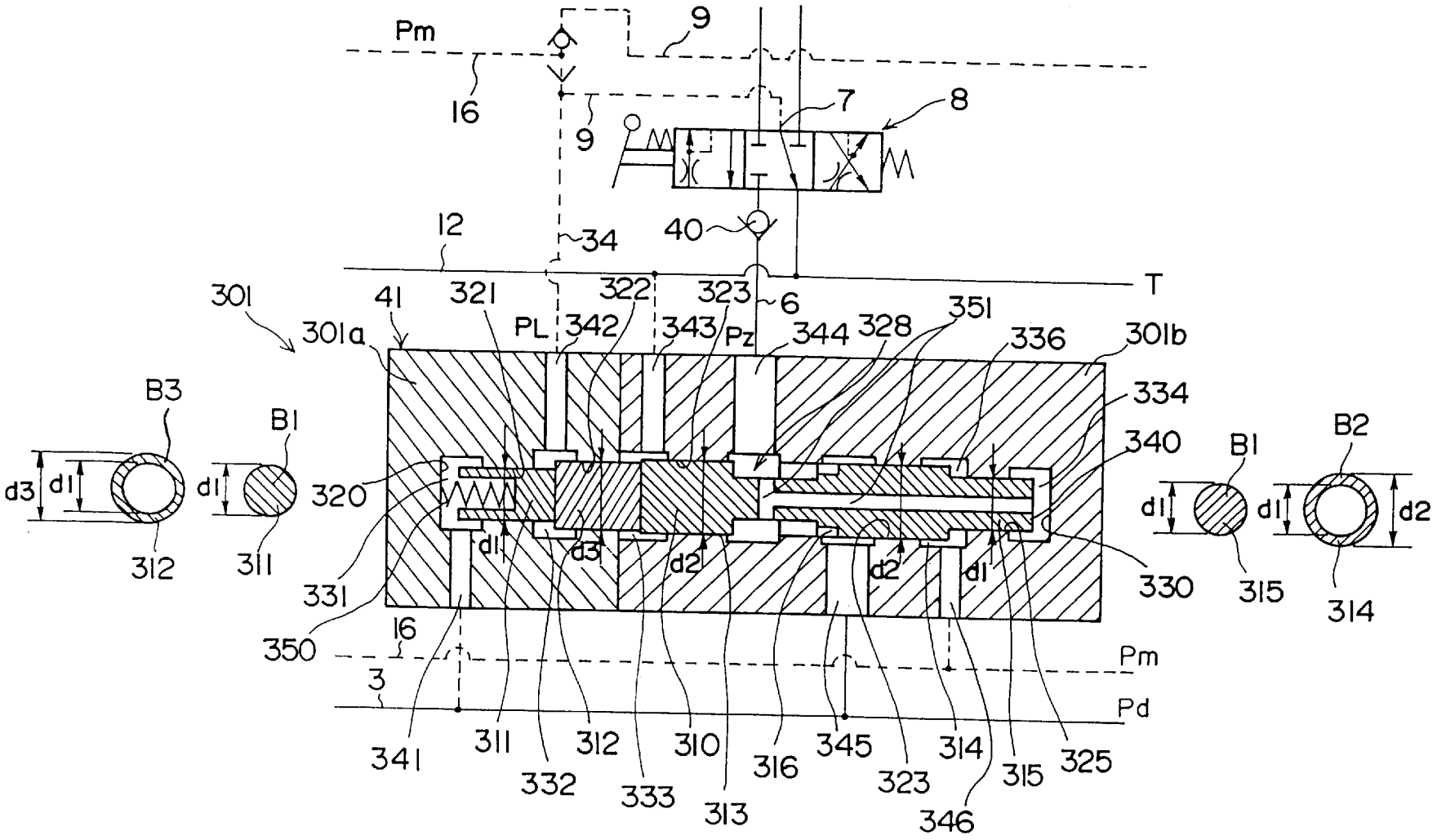
FIG. 5 is a conceptual structure diagram showing a section which shows a pressure compensation valve employed for the hydraulic device shown in FIG. 1.

Referring now to FIG. 5, a pressure compensation valve 41 which is used in the circuit of FIG. 1 embodying the first aspect of the present invention will be described. A body 301 of the pressure compensation valve 41 is divided into a first body 301*a* and a second body 301*b* which are assembled into one piece by tightening with a bolt or the like (not shown). The first body 301*a* is provided with a small diameter bore 321 and a medium diameter bore 322 which continues from the small diameter bore; and a first spool 311 fits in the small diameter bore 321 and a second spool 312 fits in the medium diameter bore 322. The second body 301*b* is provided with a large diameter bore 323 which continues from the medium diameter bore 322 and an auxiliary small diameter bore 325 which continues from the large diameter bore and which has the same diameter as that of the small diameter bore 321. A third spool 310 which fits in the large diameter bore 323 and the auxiliary small diameter bore 325 has a first and second large diameter lands 313, 314 which fit in the large diameter bore 323 and an auxiliary small diameter portion 315 which fits in the auxiliary small diameter bore 325. A spring 350 for pressing the foregoing respective spools is disposed between the first spool 311 and an end surface 320 of the small diameter bore 321. Further, provided in order along the body 301 are: an auxiliary inlet port 341 which communicates with the small diameter bore 321 and thence with the pump delivery line 3; an actuator loaded pressure port 342 which communicates with the medium diameter bore 322 and thence with an actuator loaded pressure line 34; a tank port 343 communicating with the large diameter bore 323 which surrounds the portion where the second spool 312 is in contact with the third spool 310; an outlet port 344 communicating with the large diameter bore 323 which is located between the first and second large diameter lands 313 and 314; an inlet port 345 communicating with the pump delivery line 3, the opening of which is controlled by a throttle portion 316 which is provided on the second large diameter land 314 and which can be opened or closed; and a maximum loaded pressure port 346 which communicates with a line 16 for picking up the maximum loaded pressure among the actuators and which also communicates with the large diameter bore 323 at the connecting portion of the second large diameter land 314 and the auxiliary small diameter portion 315. Provided between the auxiliary small diameter portion 315 and an auxiliary small diameter bore end surface 330 is a control pressure chamber 334 which communicates with the outlet port 344 via a pilot line 351. Since the first body 301*a* and the second body 301*b* are assembled by bolting or other similar means (not shown) into one piece to constitute the body 301, even if the medium diameter bore 322 of the first body 301*a* and the large diameter bore 323 of the second body 301*b* are not aligned, there should be no operational problem because the second spool 312 and the third spool 310 are separate components and they are merely in contact with each other.

The pressure compensation valve 41 causes an outlet pressure (Pz) of the outlet port 344 to be applied, via a pilot line 351, to an end surface 340 (a pressure receiving area B1 of the oil chamber 334) of the auxiliary small diameter portion 315 of the oil chamber 334 in a closing direction of the pressure compensation valve, and it also causes a maximum loaded pressure (Pm) of the maximum loaded pressure port 346 to be applied to a pressure receiving area B2 obtained by subtracting the sectional area of the auxiliary small diameter portion 315 from the sectional area of the second large diameter land 314. Further, pressure compensation valve 41 causes a pump delivery pressure (Pd) to be applied, via the auxiliary inlet port 341, to a pressure receiving area B1 of a control pressure chamber 331 which is the sectional area of the first spool 311, and it also causes an actuator loaded pressure (PL) of the loaded pressure port 342 to be applied to a pressure receiving area B3 of a control pressure chamber 332 obtained by subtracting the sectional area B1 of the first spool 311 from the sectional area of the second spool 312. The sectional area obtained by subtracting the sectional area of the second spool 312 from the sectional area of the first large diameter land 313 communicates with the tank through the tank port 343; therefore, no acting force for opening or closing the respective spools will be exerted.

And the pressure receiving area B2 and the pressure receiving area B1 of the first spool are set to the same value (B1=B2), the pressure receiving area B3 is set to a value which is smaller than the pressure receiving area B1 (=B2) to establish a relationship indicated by B1>B3, and the flow of the pressure compensation valve 41 communicating with a particular actuator is decreased as the loaded pressure (PL) of the particular actuator increases.

In the operation, the force of the spring 350 which pushes the respective spools is as weak as that of the spring 118 shown in FIG. 3; therefore, this force will be ignored in the following expressions.

The balance of the forces applied to the spools under a condition wherein the spools of the pressure compensation valve 41 are balanced may be expressed as follows:

$$Pz \cdot B1 + Pm \cdot B2 = Pd \cdot B1 + PL \cdot B3 \quad \ldots (8)$$

B1=B2, therefore;

$$Pz \cdot B1 + Pm \cdot B1 = Pd \cdot B1 + PL \cdot B3 \quad \ldots (9)$$

$$Pz + Pm = Pd + PL \cdot (B3/B1)$$

Since B1>B3, substituting (B3/B1)=k leads to $$Pz + Pm = Pd + PL \cdot k \quad \ldots (10)$$

where k<1; substituting k=1−(1−k) leads to $$Pz + Pm = Pd + PL \cdot [1-(1-k)]$$

$$Pz + Pm = Pd + PL - PL \cdot (1-k) \quad \ldots (11)$$

ΔP=Pz−PL; therefore, the following expression is derived from the expression (11)

$$Pz - PL = -Pm + Pd - PL \cdot (1-k) \quad \Delta P = Pz - PL = (Pd - Pm) - PL \cdot (1-k). \ldots (12)$$

Since Pc shown in FIG. 3 is expressed as Pc=Pd−Pm; therefore, the pressure compensation valve 41 shown in FIG. 5 also provides the same operation as that of the pressure compensation valve 4 illustrated in FIG. 3.

For the same reason as that of the pressure compensation valve 4 illustrated in FIG. 3, in the pressure compensation valves 41, 42 of the hydraulic device according to the first aspect of the present invention, when at least two actuators out of the plurality of actuators must be driven in synchronization regardless of the loaded pressure of the actuators as in a case where two travel motors for driving a pair of crawlers of a hydraulic traveling vehicle are run, it is preferred that the values obtained by dividing the third pressure receiving areas B3 of the two pressure compensation valves 41, 42 which communicate with the two actuators by the first pressure receiving areas B1 are the same.

Preferably, the values obtained by dividing the third pressure receiving areas B3 of the two pressure compensation valves 41, 42 by the first pressure receiving areas B1 range from 0.99 to 0.95, i.e. 99% to 95%. This is because, if the flow decreasing rate is too high, then excessive correction tends to be made when traveling straight with consequent meandering, or the system tries to keep the straight travel when making a turn, resulting in unsmooth operation; on the other hand, if the flow decreasing rate is too low, then correction cannot be made, impairing the straight traveling performance.

For the same reason as that of the pressure compensation valve 4 illustrated in FIG. 3, it is preferred that, in the pressure compensation valves 41, 42 of the hydraulic device according to the first aspect of the present invention, the value obtained by dividing the third pressure receiving area B3 of a high-load pressure compensation valve 42 communicating with the high-load actuator 20 by the first pressure receiving area B1 is set so that it is smaller than the value obtained by dividing the third pressure receiving area B3 of a low-load pressure compensation valve 41 communicating with a low-load actuator 10 by the first pressure receiving area B1 when the loaded pressure of the high-load actuator 20 of at least two actuators 10, 20 among a plurality of actuators is extremely higher than the loaded pressure of the other, namely, low-load, actuator 10. Preferably, the value obtained by dividing the third pressure receiving area by the first pressure receiving area of the pressure compensation valve of the foregoing low-load actuator ranges from 1 to 0.98, and the value obtained by dividing the third pressure receiving area by the first pressure receiving area of the pressure compensation valve of the high-load actuator ranges from 0.97 to 0.94.

Thus, all the embodiments above have been described by referring to the hydraulic circuits for driving two hydraulic actuators; however, for instance, an actual hydraulic excavator operates at least six actuators including two travel motors for driving a pair of crawlers of a hydraulic traveling vehicle, a swing hydraulic motor for a cab, and the hydraulic cylinders for a boom, an arm, and a bucket. This means that the each of the embodiments described above shows only two actuators which represent those actuators, and it should be understood that a plurality of hydraulic actuators in this invention include the individual travel motors, the swing hydraulic motors, and the hydraulic cylinders, and so on, and further include a plurality of pressure compensation valves and directional valves which communicate respectively with the hydraulic actuators.

The present invention may be embodied in other specific forms without departing from the spirit thereof, and those other specific forms are therefore intended to be embraced therein.

What is claimed is:

1. A hydraulic device comprising:

first and second hydraulic actuators driven by delivery oil, each hydraulic actuator having a loaded pressure;

first and second directional valves for controlling the delivery oil flowing into the first and second actuators, respectively;

first and second pressure compensation valves coupled to and for compensating pressures of the first and second directional valves, respectively, each pressure compensation valve decreasing flow of the delivery oil to the respective actuator when the loaded pressure of the respective actuator is increased;

a variable displacement pump for pumping the delivery oil to the first and second actuators;

a displacement varying means coupled to the variable displacement pump; and a pump flow control valve for communicating the delivery oil of the variable displacement pump with the displacement varying means.

2. A hydraulic device as in claim 1, wherein the first compensation valve receives the loaded pressure of the first actuator, a maximum loaded pressure of the loaded pressures of the hydraulic actuators of the hydraulic device, a pump delivery pressure of the variable displacement pump, and an output pressure on a downstream side of the first pressure compensation valve, such that the output pressure and the maximum loaded pressure act in a first control pressure chamber of the first pressure compensation valve to close the first pressure compensation valve, and the pump delivery pressure and the loaded pressure of the first hydraulic actuator act in a second control pressure chamber of the first pressure compensation valve to open the first pressure compensation valve.

3. A hydraulic device as in claim 1, wherein the pump flow control valve has a spring and receives a pump delivery pressure of the variable displacement pump and a maximum loaded pressure of the loaded pressures of the hydraulic actuators of the hydraulic device, such that the maximum loaded pressure and the spring act to close the pump flow control valve to increase displacement of the variable displacement pump, and the pump delivery pressure acts to open the pump flow control valve to decrease displacement of the variable displacement pump.

4. A hydraulic device as in claim 1, further comprising a differential control valve for generating a secondary pressure based on a pump delivery pressure of the variable displacement pump and a maximum loaded pressure of the loaded pressures of the hydraulic actuators of the hydraulic device;

wherein the first compensation valve receives the secondary pressure, the loaded pressure of the first hydraulic actuator, and an output pressure on a downstream side of the first pressure compensation valve, such that the output pressure acts in a first control pressure chamber of the first pressure compensation valve to close the first pressure compensation valve, and the secondary pressure and the loaded pressure of the first hydraulic actuator act in a second control pressure chamber of the first pressure compensation valve to open the first pressure compensation valve.

5. A hydraulic device as in claim 4, wherein the pump flow control valve has a spring and receives the secondary pressure, such that the spring acts to close the pump flow control valve to increase displacement of the variable displacement pump, and the secondary pressure acts to open the pump flow control valve to decrease displacement of the variable displacement pump.

6. A hydraulic device comprising:

a variable displacement pump for pumping delivery oil, a plurality of hydraulic actuators driven by the delivery oil of the variable displacement pump, a plurality of directional valves having a flow control function capable of controlling the delivery oil flowing into each of the plurality of actuators, and a plurality of pressure compensation valves (41,42) for compensating the pressures of the respective directional valves;

wherein each of the pressure compensation valves decreases its output flow supplied to a respective actuator when a loaded pressure of the respective actuator is increased;

wherein each of the pressure compensation valves causes a pressure on the downstream side of the pressure compensation valve and a maximum loaded pressure of the plurality of actuators to act in a closing direction in a control pressure chamber of the pressure compensation valve, and cause a pump delivery pressure which is a pressure on the upstream side of the pressure compensation valve and an actuator loaded pressure which is a pressure on the downstream side of the respective directional valve to act in an opening direction of the pressure compensation valve in an another control pressure chamber to perform the pressure compensation;

wherein the hydraulic device further comprises a pump flow control valve adapted to communicate the delivery oil of the variable displacement pump with a displacement varying means of the variable displacement pump;

wherein the maximum loaded pressure via a line and an acting force of a spring of the pump flow control valve are applied in a direction for closing the pump flow control valve to increase the displacement of the variable displacement pump, whereas the pump delivery pressure is applied via another line n a direction for opening the pump flow control valve to decrease the displacement of the variable displacement pump.

7. A hydraulic device according to claim 6, wherein the pressure compensation valve comprises:

a body composed of a first body and a second body tightened with each other in one piece;

a small diameter bore and a medium diameter bore continuing from the small diameter bore, the small and medium diameter bores bing provided in the first body;

a first spool fitted in the small diameter bore;

a second spool fitted in the medium diameter bore;

a large diameter bore continuing from the medium diameter bore;

an auxiliary small diameter continuing from the large diameter bore and having the same diameter as that of the small diameter bore, the large and auxiliary small diameter bores being provided in the second body;

a third spool having first and second large diameter lands fitted in the large diameter bore and an auxiliary small diameter portion fitted in the auxiliary small diameter bore;

a spring for pressing the respective spools disposed between the first spool and an end surface of the small diameter bore of the body;

an auxiliary inlet port for communicating with the small diameter bore through a pump delivery line;

an actuator loaded pressure port for communicating with the medium diameter bore through an actuator loaded pressure line;

a tank port for communicating with the large diameter bore at a contact portion of the second spool and the third spool;

an outlet port for communicating with the large diameter bore located between the first and second large diameter lands;

an inlet port for communicating with the pump delivery line and having an opening controlled by a throttle portion provided on the second large diameter land, the opening can be opened or closed;

a maximum loaded pressure port for communicating with a line for picking up the maximum loaded pressure from the actuators and for communicating with the large diameter bore at the connecting portion of the second large diameter land and the auxiliary small diameter portion, wherein the actuator loaded pressure port, the tank port, the outlet port, the inlet port, and the maximum loaded pressure port are provided in order along the body;

a control pressure chamber for communicating with the outlet port via pilot line and being provided between the auxiliary small diameter bore end surface;

wherein the pressure compensation valve causes the outlet port pressure to be applied in a closing direction, via the pilot line, to a first pressure receiving are on an end surface of the auxiliary small diameter portion in the control pressure chamber and causes a maximum loaded pressure of the maximum loaded pressure port to be applied in a closing direction to a second pressure receiving area of a control pressure chamber communicating with the maximum loaded pressure port, the second pressure receiving area being nearly the same size as an area obtained by subtracting the first pressure receiving area of the auxiliary small diameter portion from the sectional area of the second large diameter land;

wherein the pressure compensation valve causes the pump delivery pressure to be applied to a fourth pressure receiving area of the first spool via the auxiliary inlet port and causes the actuator loaded pressure of the loaded pressure port to be applied to a third pressure receiving area, the third pressure receiving area nearly the same size as an area obtained by subtracting the fourth pressure receiving area of the first spool from the sectional area of the medium diameter bore; and wherein the second pressure receiving area and the first pressure receiving area of the first spool are nearly the same size, and the third pressure receiving area is larger than the first pressure receiving area of the first spool so as to decrease the flow of the pressure compensation valve communicating with one of the actuators according to an increase in the loaded pressure of the actuator.

8. A hydraulic device according to claim 7, wherein a value obtained by dividing the third pressure receiving area of the pressure compensation valve by the first pressure receiving area ranges from 0.99 to 0.95 .

9. A hydraulic device according to claim 7, wherein, when at least two actuators out of the plurality of actuators must be driven in synchronization with each other regardless of the loaded pressure of the actuators, values obtained by dividing the third pressure receiving areas of the two pressure compensation valves which communicate with the two actuators by the first pressure receiving areas are equal.

10. A hydraulic device according to claim 7, wherein a value obtained by dividing the third pressure receiving area of a pressure compensation valve communicating with a first actuator having a high-load by the first pressure receiving area is smaller than a value obtained by dividing the third pressure receiving area of a pressure compensation valve communicating with a second actuator having a low-load by the first pressure receiving area when the loaded pressure of the first actuator of the at least two actuators out of the plurality of hydraulic actuators is extremely higher than the loaded pressure of the second actuator.

11. A hydraulic device according to claim 10, wherein the value obtained by dividing the third pressure receiving are of the pressure compensation valve of the second actuator by the first pressure receiving area ranges from 1 to 0.98, and the value obtained by dividing the third pressure receiving area of the pressure compensation valve of the first actuator by the first pressure receiving area ranges from 0.97 to 0.94.

12. A hydraulic device comprising:

a variable displacement pump for pumping delivery oil;

a plurality of hydraulic actuators driven by the delivery oil of the variable displacement pump, a plurality of directional valves having a flow control function capable of controlling the pressure oil flowing into each of the plurality of actuators, a plurality of pressure compensation valves for compensating the pressures of the respective directional valves, a differential pressure control valve for generating a secondary pressure corresponding to a differential pressure between a pump delivery pressure and a maximum loaded pressure of the actuators, and a pump flow control valve for communicating the delivery oil of the variable displacement pump with the displacement varying means of the variable displacement pump;

wherein each pressure compensation valve is adapted so that a pressure on the downstream side of the pressure compensation valve acts in a direction for closing the pressure compensation valve in a control pressure chamber and so that a secondary pressure supplied from the differential pressure control valve and an actuator loaded pressure which is a pressure on the downstream side of the respective direction valve act in a direction for opening the pressure compensation valve in another control pressure chamber;

wherein an acting force of a spring of the pump flow control valve is applied in a direction for closing the pump flow control valve to increase the displacement of the variable displacement pump, whereas the secondary pressure is applied via a line in a direction for opening the pump flow control valve of the variable displacement pump to decrease the displacement of the variable displacement pump.

13. A hydraulic device according to claim 12, wherein the pressure compensation valves decrease the output flow of the pressure compensation valves, which communicate with the respective actuators, in accordance with an increase in the loaded pressure of the corresponding actuators.

14. A hydraulic device according to claim 13, wherein the pump flow control valve causes the maximum loaded pressure to act via a line in a direction for closing the pump flow control valve to increase the displacement of the variable displacement pump, and causes the pump delivery pressure to act via another line in a direction for opening the pump flow control valve to decrease the displacement of the variable displacement pump.

15. A hydraulic device according to claim 14, wherein the secondary pressure is supplied by an electromagnetic proportional valve, the electromagnetic proportional valve is operated by a control signal outputted by a control unit, the control unit generates the control signal from a differential pressure signal outputted by a differential pressure detector, the differential pressure detector detects a differential pressure signal between the delivery pressure of the variable displacement pump and the maximum loaded pressure.

16. A hydraulic device according to claim 13, wherein:

the pressure compensation valves are provided on the upstream side of the respective directional valves;

the pressure compensation valves cause outlet pressure on the downstream side thereof on a first pressure receiving area of a first control pressure chamber in a direction for closing the valves, cause the secondary pressure to act on a second pressure receiving area of a second control pressure chamber in a direction for opening the valves, and cause the loaded pressure of the actuators to act on a third pressure receiving area of a third control pressure chamber in a direction for opening the valves; and the second and third pressure receiving areas are made nearly the same, while the first pressure receiving area is made larger than the third pressure receiving area.

17. A hydraulic device according to claim 16, wherein one of the pressure compensation valves comprises:

a valve body;

a valve body bore provided in the valve body having a small diameter bore and a large diameter bore continuing therefrom;

a spool fitted in the valve body bore and having a small diameter portion fitted slidably in the small diameter bore and first and second large diameter lands fitted slidably in the large diameter bore; and an actuator loaded pressure port, a secondary pressure port, an outlet port, an inlet port for communicating with a pump delivery line, and a tank port provided in order on the valve body along the valve body bore;

wherein the small diameter portion on one end of the spool fitted slidably in the small diameter bore is brought in contact with one end surface of the valve body bore via a spring and forms therebetween a third control pressure chamber for communicating with the loaded pressure port;

wherein between the other end of the spool and the other end surface of the valve body bore a tank chamber is formed for communicating with the tank port;

wherein a second control pressure chamber for communicating with the secondary pressure port is formed in the large diameter bore and encircles the spool connecting the small diameter portion and the first large diameter land;

wherein a piston is slidably inserted, in an oiltight nested fashion, in an axial bore provided in the other end of the spool, and one end of the piston is arranged for containing the other end surface of the valve body bore and disposed in the oil tank chamber;

wherein a first control pressure chamber for communicating with the outlet port via a pilot line is formed between the spool and the piston in the axial bore;

wherein a first pressure receiving area of the first control pressure chamber is formed by the sectional area of the piston, a second pressure receiving area of the second control pressure chamber is forced by the area obtained by subtracting the sectional area of the small diameter bore from the sectional area of the large diameter bore, and a third pressure receiving area of the third control pressure chamber is formed by the sectional area of the small diameter portion;

wherein the spool has a notched throttle portion which can be opened and closed to throttle the pump delivery flow from the inlet port to the outlet port the throttle portion being provided on the second large diameter land facing the first large diameter land;

wherein the second pressure receiving area is nearly the same size as the third pressure receiving area, and the third pressure receiving area is smaller than the first pressure receiving area so as to decrease the output flow of the pressure compensation valve, which communicates with one of the actuators, according to an increase in the loaded pressure of the actuator.

18. A hydraulic device according to claim 16, wherein one of the pressure compensation valves comprises:

a valve body;

a valve body bore provided in the valve body;

a spool having first, second, and third large diameter lands slidably fitted in the valve body bore; and a secondary pressure port, an actuator loaded pressure port, an outlet port, an inlet port for communicating with a pump delivery line, and a tank port provided in order on the valve body along the valve body bore;

wherein an auxiliary piston is slidably inserted, in an oiltight and nested fashion, in a sub-axial bore provided on one end of the spool, and an end of the auxiliary piston is arranged for contacting an end surface of the valve body bore to form a second control pressure chamber therebetween for communicating with the secondary pressure port;

wherein a spring is provided between the spool and the auxiliary piston in the sub-axial bore, and in which a third control pressure chamber which communicates with the loaded pressure port via an auxiliary pilot line is formed;

wherein between the other end of the spool and the other end surface of the valve body bore a tank chamber is formed for communicating with the tank port;

wherein a piston is slidably inserted, in an oiltight and nested fashion, in an axial bore provided on the other end of the spool, and one of the pistons is arranged for contacting the other end surface of the valve body bore disposed in the tank chamber;

wherein a first control pressure chamber for communicating with the outlet pressure port via a pilot line is formed between the spool and the piston in the axial bore;

wherein a first pressure receiving area of the first control pressure chamber is formed by the sectional area of the piston, a second pressure receiving area of the second control pressure chamber is formed by the area obtained by subtracting the sectional area of the auxiliary piston from the sectional area of the valve body bore, and a third pressure receiving area of the third control pressure chamber is formed by the sectional area of the auxiliary piston;

wherein the spool has a notched throttle portion which can be opened and closed to throttle the pump delivery flow from the inlet port to the outlet port provided on the third large diameter land facing the second large diameter land;

wherein the second pressure receiving area is nearly the same size as the third pressure receiving area, and the third pressure receiving area is smaller than the first pressure receiving area so as to decrease the output flow of the pressure compensation valve, which communicates with one of the actuators, according to an increase in the loaded pressure of the actuator.

19. A hydraulic device according to claim 16, wherein a value obtained by dividing the third pressure receiving area of the pressure compensation valve by the first pressure receiving area ranges from 0.99 to 0.95 .

20. A hydraulic device according to claim 19, wherein, when at least two actuators out of the plurality of actuators must be driven in synchronization with each other irrespective of the loaded pressure of the actuators, values obtained by dividing the third pressure receiving areas of the two pressure compensation valves communicating with the two actuators by the first pressure receiving areas are the same.

21. A hydraulic device according to claim 16, wherein a value obtained by dividing the third pressure receiving area of one of the pressure compensation valves communicating with one of the actuators having a high-load by the first pressure receiving area is set so that the value is smaller than a value obtained by dividing the third pressure receiving area of one of the pressure compensation valves communicating with one of the actuators having a low-load by the first pressure receiving area when the loaded pressure of the high-load actuator is extremely higher than the loaded pressure of the low-load actuator.

22. A hydraulic device according to claim 21, wherein the value obtained by dividing the third pressure receiving area of the pressure compensation valve of the low-load actuator by the first pressure receiving area ranges from 1 to 0.98, and the value obtained by dividing the third pressure receiving area of the pressure compensation valve of the high-load actuator by the first pressure receiving area ranges from 0.97 to 0.94.

23. A hydraulic device comprising:

a variable displacement pump for pumping delivery oil, a plurality of hydraulic actuators driven by the delivery oil of the variable displacement pump, a plurality of directional valves having a flow control function capable of controlling the pressure oil flowing into each of the plurality of actuators, a plurality of pressure compensation valves disposed between respective directional valves and respective actuators and for compensating the outlet pressures of the respective directional valves with respect to the maximum loaded pressure among the actuators, each pressure compensation valve having a spring;

wherein each pressure compensation valves causes an acting force of the springs of the pressure compensation valves and the maximum loaded pressure among the actuators to act in a direction for closing the pressure compensation valves in a control pressure chamber, and causes a pressure on an upstream side of the pressure compensation valve to act in a direction for opening the pressure compensation valve in another control pressure chamber;

wherein a differential pressure control valve is provided for generating a secondary pressure corresponding to a differential pressure between a pump delivery pressure and a maximum loaded pressure of the actuators;

wherein a pump flow control valve causes the delivery oil of the variable displacement pump to communicate with a displacement varying means of the variable displacement pump; and wherein the secondary pressure is applied via a line so that the pump flow control valve is closed to decrease the displacement of the variable displacement pump.

* * * * *